US007930865B2

(12) United States Patent
Barlow

(10) Patent No.: US 7,930,865 B2
(45) Date of Patent: Apr. 26, 2011

(54) METHOD OF INSTALLING AN INTERLOCKING FLOOR SYSTEM

(76) Inventor: David R. Barlow, Seminole, FL (US)

( * ) Notice: Subject to any disclaimer, the term of this patent is extended or adjusted under 35 U.S.C. 154(b) by 281 days.

(21) Appl. No.: 12/408,003

(22) Filed: Mar. 20, 2009

(65) Prior Publication Data

US 2009/0178367 A1 Jul. 16, 2009

Related U.S. Application Data

(63) Continuation-in-part of application No. 11/535,805, filed on Sep. 27, 2006, now Pat. No. 7,516,587.

(51) Int. Cl.
*E04B 2/00* (2006.01)
*E04F 15/00* (2006.01)

(52) U.S. Cl. ..... 52/741.11; 52/591.2; 52/177; 52/385; 428/192; 404/41

(58) Field of Classification Search ..... 52/384, 52/385, 390, 391, 392, 177, 311.2, 574, 591.1, 52/591.2, 592.1, 588.1, 589.1, 741.11, 747.11, 52/747.12; 404/18, 33, 35, 41; D25/138; 428/192; 405/16, 17
See application file for complete search history.

(56) References Cited

U.S. PATENT DOCUMENTS

| | | | | |
|---|---|---|---|---|
| 841,490 | A * | 1/1907 | Montier | 52/591.2 |
| 3,735,988 | A * | 5/1973 | Palmer et al. | 473/162 |
| 4,590,726 | A * | 5/1986 | Salazar | 52/314 |
| 5,163,424 | A | 9/1992 | Kohnke | |
| 6,082,886 | A | 7/2000 | Stanford | |
| 6,793,586 | B2 | 9/2004 | Barlow | |
| 7,287,357 | B2 * | 10/2007 | Gomez Insa | 52/464 |
| 7,516,587 | B2 * | 4/2009 | Barlow | 52/591.2 |
| 7,757,449 | B2 * | 7/2010 | Portoles Ibanez et al. | 52/384 |
| 2003/0009971 | A1 | 1/2003 | Palmberg | |
| 2005/0028475 | A1 | 2/2005 | Barlow | |
| 2008/0092473 | A1 * | 4/2008 | Heyns | 52/385 |

* cited by examiner

*Primary Examiner* — Robert J Canfield
*Assistant Examiner* — Brent W Herring
(74) *Attorney, Agent, or Firm* — Larson & Larson, P.A.; Frank Liebenow; Justin Miller

(57) ABSTRACT

A method of installing an interlocking floor system includes surface preparation, assembly of the polymeric panels making up the interlocking floor system and affixing a turf material over the polymeric panels.

23 Claims, 29 Drawing Sheets

METHOD OF INSTALLING AN INTERLOCKING FLOOR SYSTEM

CROSS-REFERENCE TO RELATED APPLICATION

This is a continuation-in-part application to allowed U.S. patent application Ser. No. 11/535,805 titled, "Interlocking Floor System," filed Sep. 27, 2006, the disclosure of which is herein incorporated by reference.

FIELD OF THE INVENTION

The present invention relates to flooring. More particularly, it refers to the installation of multi-sectional interlocking polymeric panels held together by a mechanical locking feature, the panels forming a floor surface or under laying surface.

BACKGROUND OF THE INVENTION

Surface coverings, such as carpet, linoleum, wood flooring, rubberized flooring system, and tile, need to be laid over a base that will support the surface covering. Commonly, surface coverings are laid over a base of plywood or cement. These base materials are expensive to install, and once installed are difficult to remove. Recreational surfaces frequently need to be moved to different locations because the same site may be used for different activities, such as an ice rink converted to a basketball court or concert stage. A need exists for an inexpensive, easily movable base surface as a stand-alone floor surface or for use in conjunction with multiple surface coverings.

US Pub. No. 2005-0028475-A1 to Barlow describes an "Interlocked Base and an Overlaying Surface Covering," and is hereby incorporated by reference.

SUMMARY

A method of installing an interlocking floor system includes surface preparation, assembly of the polymeric panels making up the interlocking floor system and affixing a turf material over the polymeric panels.

In one embodiment, a method of installing an interlocking floor system is disclosed including providing interlocking polymeric panels comprising a rigid integral body having a planar top surface and a grid structure supporting the top surface and multiple interlocking side surfaces. Each interlocking side surface has upwardly and downwardly facing steps with the downwardly facing steps having a convex projection on a bottom surface and the upwardly facing steps having a concave mating dimple on an upper surface. An over hang ledge is formed as an extension of the planar top surface, thereby forming a cavity between the over hang ledge and the upper surface of the upwardly facing step. An under hang ledge is formed in a top surface of the downwardly facing steps allowing the downward facing steps of a first panel to fit within the cavity of a second panel. The steps of the side surfaces of the first panel interlock to complementary steps of the second panel. Next, a top portion of soil is removed and backfilled with a backfill material to replace the top portion of soil. The surface over the backfill material is prepared and compacted. Next, a cover material is installed over the surface. The multiple polymeric panels are joined and spacers are inserted between the multiple polymeric panels. Spikes are inserted through holes in at subset of the multiple polymeric panels then the spacers are removed. finally, a synthetic turf is installed over the multiple polymeric panels.

In another embodiment, a method of installing a field is disclosed including polymeric panels are disclosed including a rigid integral body having a planar top surface and a grid structure supporting the top surface and multiple interlocking side surfaces. Each interlocking side surface has upwardly and downwardly facing steps with the downwardly facing steps having a convex projection on a bottom surface and the upwardly facing steps having a concave mating dimple on an upper surface. An over hang ledge is formed as an extension of the planar top surface, thereby forming a cavity between the over hang ledge and the upper surface of the upwardly facing step. An under hang ledge is formed in a top surface of the downwardly facing steps allowing the downward facing steps of a first panel to fit within the cavity of a second panel. The steps of the side surfaces of the first panel interlock to complementary steps of the second panel. The method continues with eliminating vegetation from a field area, filling low areas and reducing high areas of the field area, preparing a surface of the field area and compacting the surface of the field area. Next, a cover material is installed over the surface of the field area. The multiple polymeric panels are joined to each other and spacers are inserted between the multiple polymeric panels. Spikes are installed through holes in at subset of the multiple polymeric panels then the spacers are removed. A synthetic turf is then deployed over the multiple polymeric panels.

In another embodiment, a method of installing an interlocked floor system is disclosed including providing polymeric panels are disclosed including a rigid integral body having a planar top surface and a grid structure supporting the top surface and multiple interlocking side surfaces. Each interlocking side surface has upwardly and downwardly facing steps with the downwardly facing steps having a convex projection on a bottom surface and the upwardly facing steps having a concave mating dimple on an upper surface. An over hang ledge is formed as an extension of the planar top surface, thereby forming a cavity between the over hang ledge and the upper surface of the upwardly facing step. An under hang ledge is formed in a top surface of the downwardly facing steps allowing the downward facing steps of a first panel to fit within the cavity of a second panel. The steps of the side surfaces of the first panel interlock to complementary steps of the second panel. The method continues with eliminating vegetation from an area, filling low areas and reducing high areas of the area and compacting the surface of the area. Next, a cover material is installed over the surface of the area. The multiple polymeric panels are then joined together and placed over the cover material.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
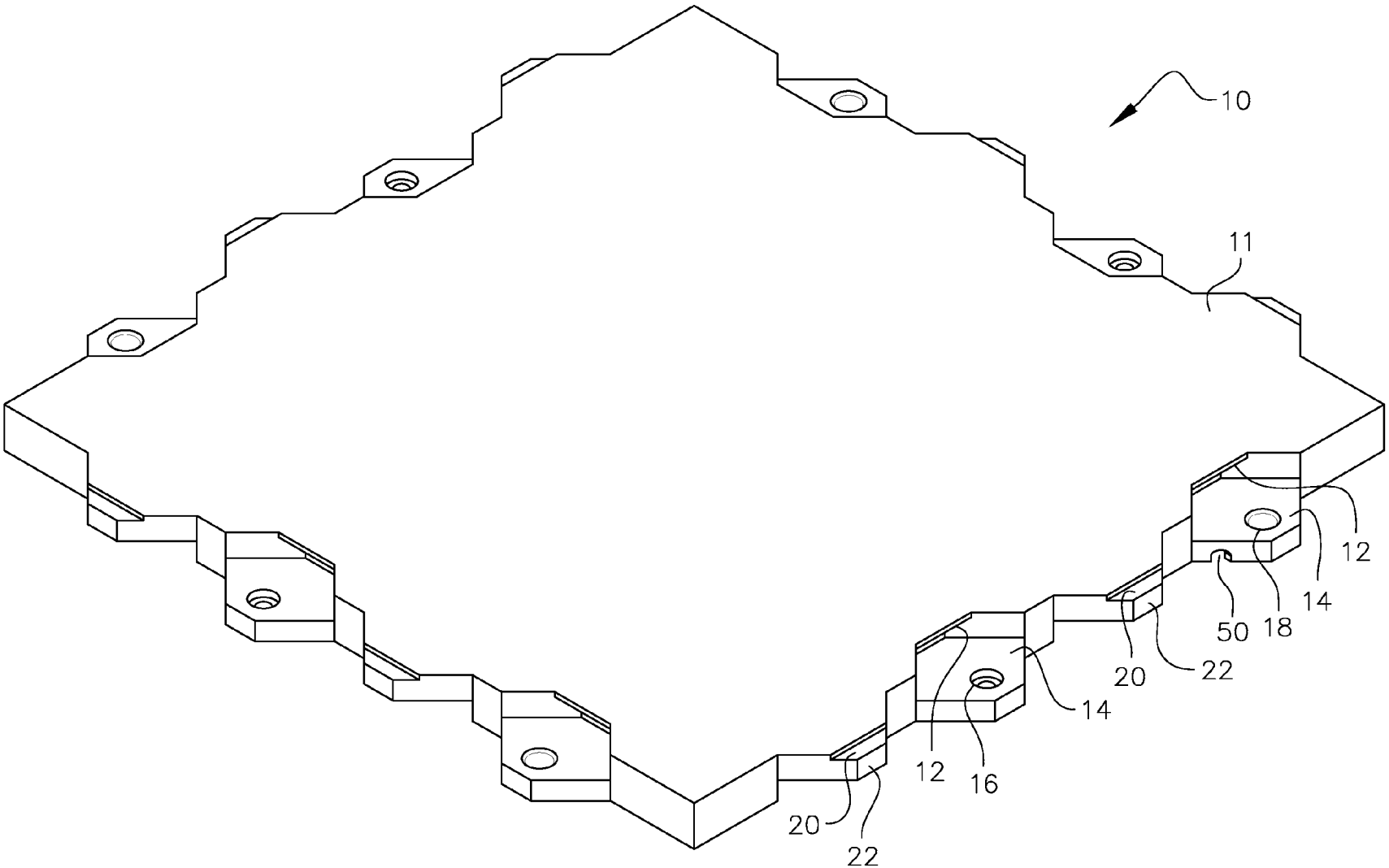
FIG. 1 is a top perspective view of a molded polymeric panel employed to form the interlocked base or floor system.

Throughout the following detailed description the same reference numerals refer to the same elements in all figures.

Figure 8:
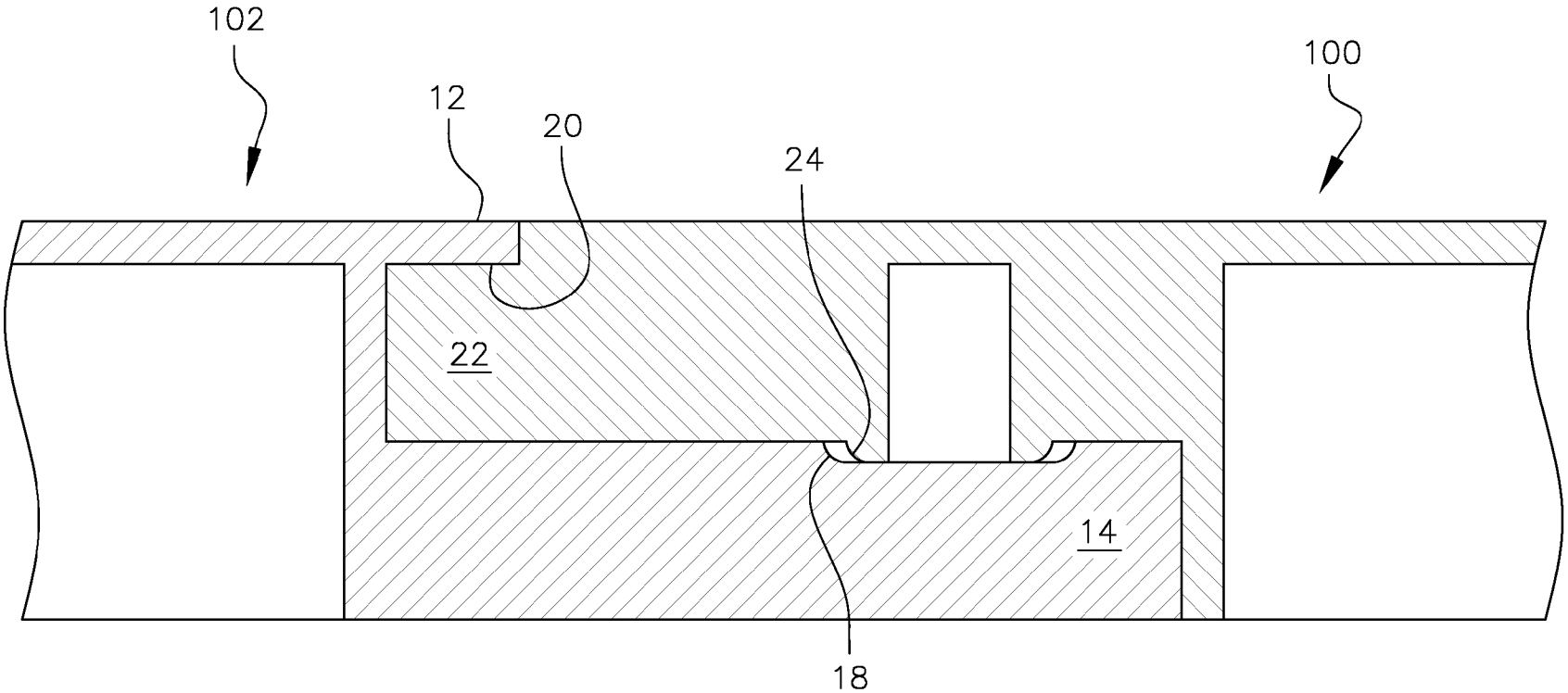
FIG. 8 is a cross-section along line 8-8 of FIG. 3 showing the adjacent polymeric edges in the panels interlocked together.
Figure 8A:
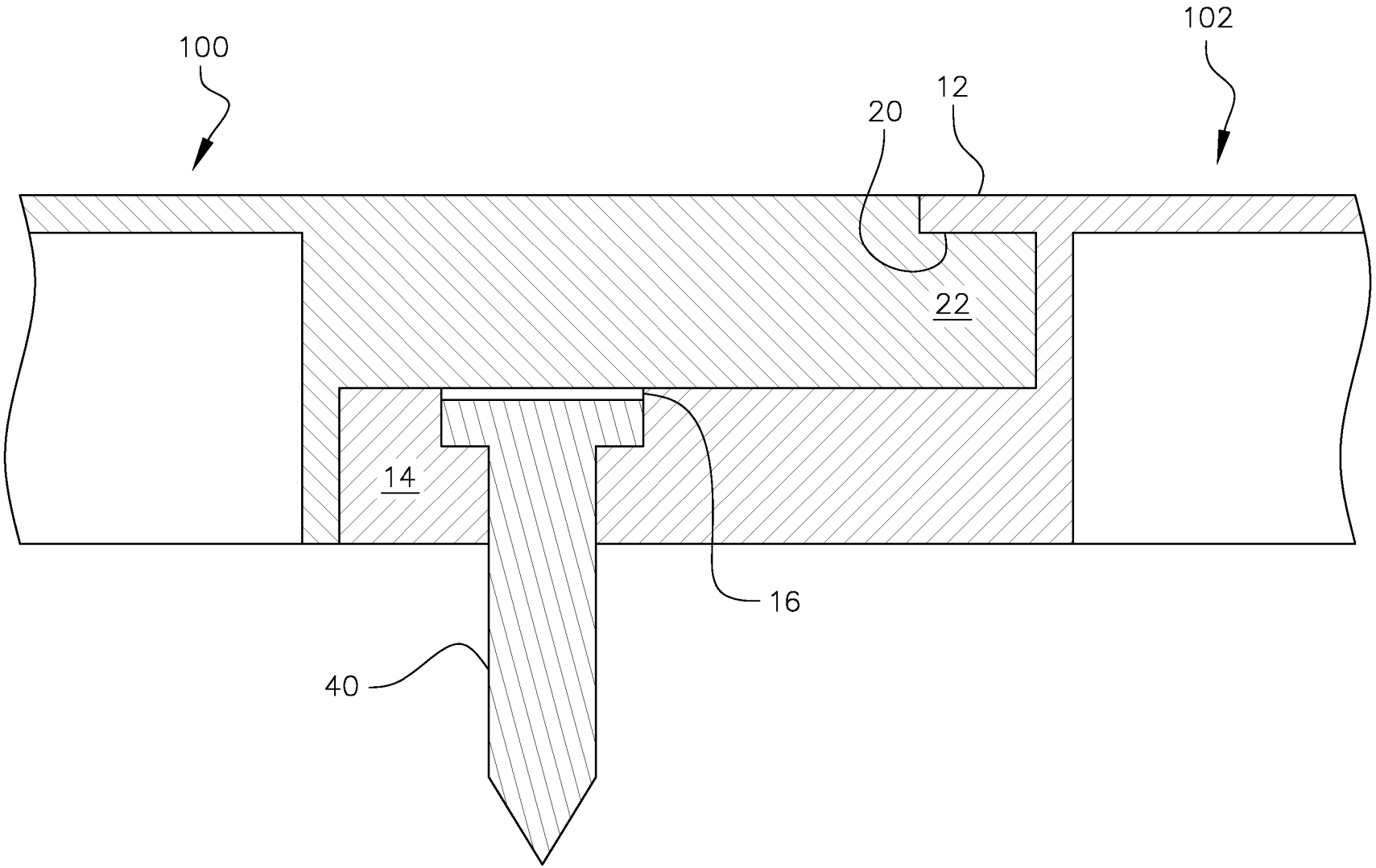
FIG. 8A is a cross-section along line 8A-8A of FIG. 3 showing the adjacent polymeric edges in the panels interlocked together and held to the subsurface with a spike or screw.

Referring to FIGS. 1, 2, 8 and 8A, panels 100/102 join together to form an interlocked series of panels arranged to be mechanically interlocked together. Each panel 10 has a planar top surface 11 and each panel 10 has upward facing steps 14 and downward facing steps 22. At least one of the downward facing steps 22 contains a downwardly pointing convex projection 24 on their lower surfaces as shown in FIG. 8. At least one of the upward facing steps 14 contains a concave mating dimple 18 on their upper surface. An under hang ledge 20 is provided to allow the downward facing steps 22 to be inserted with the under hang ledge 20 sliding into a cavity formed between the upward facing steps 14 and an overhang ledge 12, thereby engaging the convex projections 24 with concave dimples 18. The overhang ledge is a continuation of the planar top surface 11 of the panel 10. Such an interlock mechanism helps adjacent panels retain planar alignment while providing a tight mechanical interlock.

In embodiments with panels that have more than one pair of steps, it is preferred to configure the panels 10 as shown alternating the upward facing steps with the downward facing steps and with the outer steps 14/22 having the mating convex projections 24 and concave mating dimples 18. In an alternate embodiment, the upward facing steps are in a different order and do not alternate with the downward facing steps.

In some embodiments where the panels are smaller, a single pair of steps 14/22 is sufficient. In some embodiments where the panels are larger, several pair of steps 14/22 is included and more than one pair of steps includes the mating convex projections 24 and concave mating dimples 18.

The panels 10 can be disengaged by pulling them apart. In a preferred embodiment, the top planar surface 11 of the panel 10 is molded as an integral rigid body with the grid structure 25 shown in FIG. 7. In some embodiments, the top planar surface 11 is coated with a surface material such as carpet, linoleum, vinyl, wood, synthetic wood, ceramic tile, plastic tile, artificial turf, etc. In some embodiments, the top planar surface 11 is not coated and an area cover is affixed after the planar panels 10 are installed.

In some embodiments, one or more of the upwardly facing steps 14 include a secondary countersunk hole 16 for accepting an anchor fastener such as a screw or spike 40 without interfering with the interlocking action. It can be seen in FIG. 5A that the screw or spike 40 can hold the polymeric panels 100/102 to a sub floor or the ground.

Additionally, in some embodiments, a wire chase 50 is cut or molded into the sub structure of the panels 10 to permit a wire to run between the panels 10 and a sub floor (not shown). Although called a wire chase 50, this cut or opening molded into the sub structure of the panels 10 also provides for a drainage path in generally horizontal directions.

The molded integral rigid body with grid structure 25 is made from molded filled or non-filled polymers or any other suitable material including rubber, recycled rubber or any rubber-like material. The polymers can include polypropylene, structural urethane foams or other suitable commercially available polyolefins. The rubber can include structural foam and processed recycled automobile tires mixed in a bonding agent.

Figure 2:
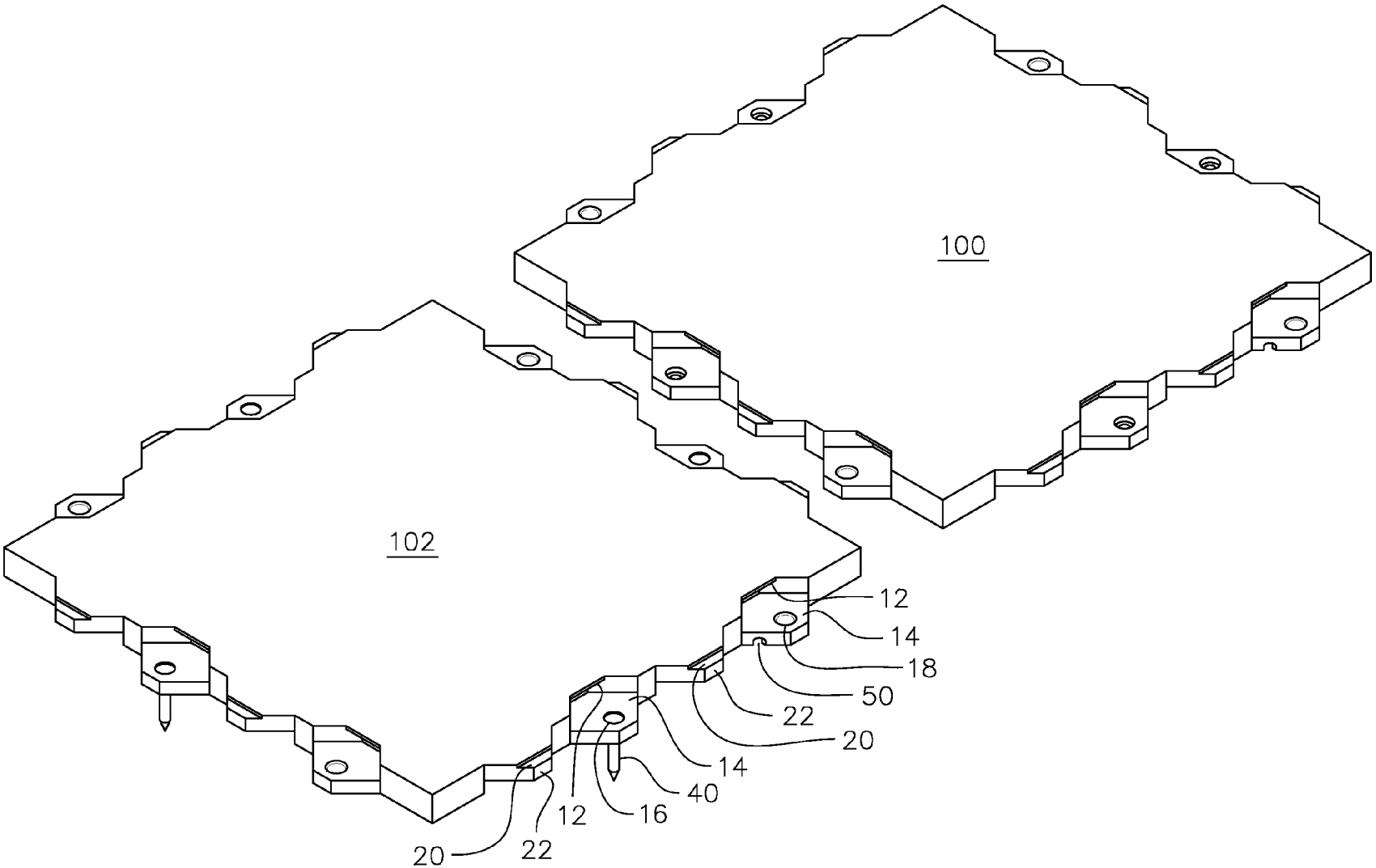
FIG. 2 is a top perspective view of two adjacent polymeric panels of FIG. 1 ready to be interlocked together at their edges.
Figure 3:
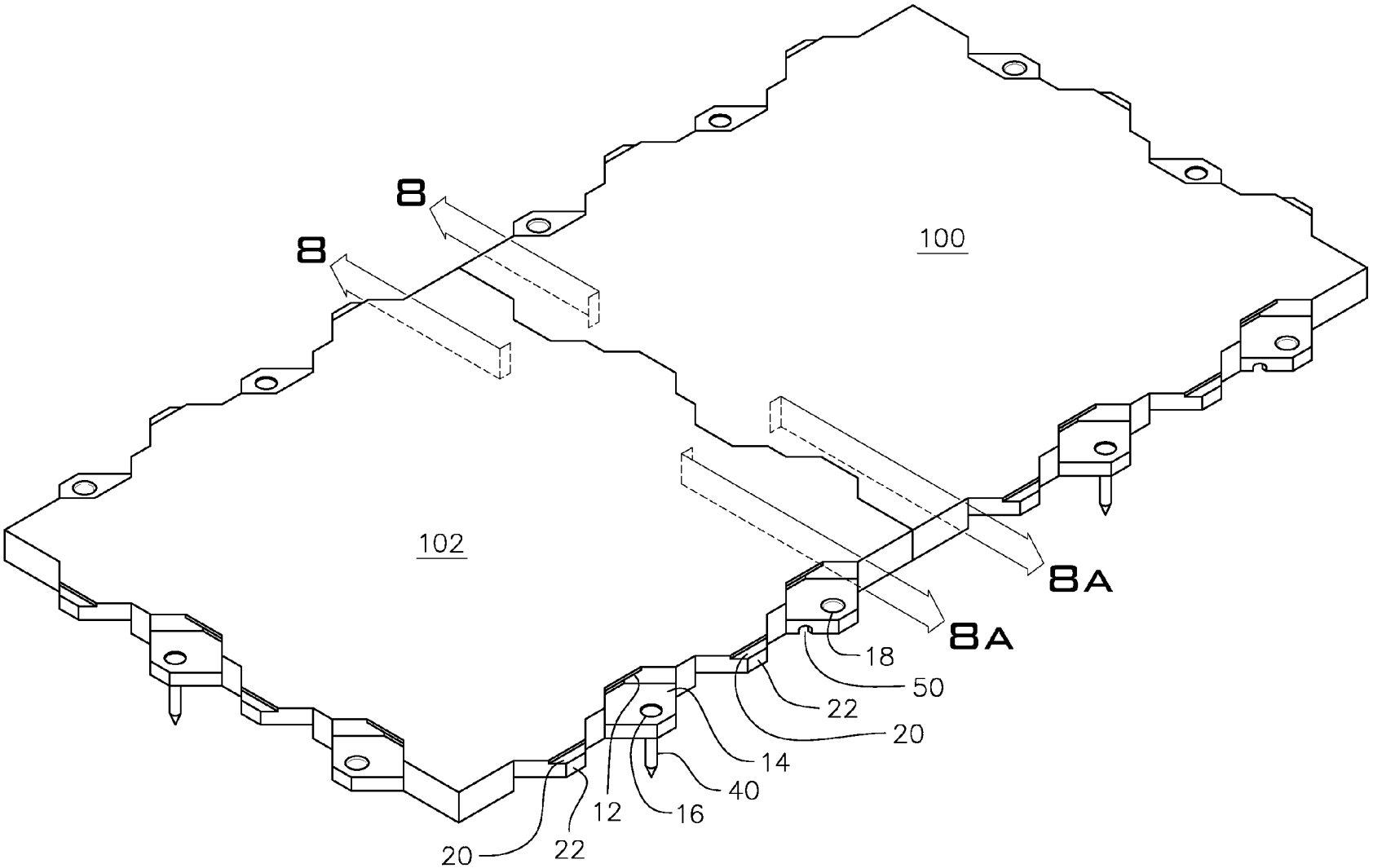
FIG. 3 is a top perspective view of two adjacent polymeric panels of FIG. 1 interlocked together at their edges.

Referring to FIGS. 2 and 3, two adjacent polymeric panels 10 of FIG. 1 are shown prior to being interlocked together (FIG. 2) and shown interlocked (FIG. 3). The panels 100/102 are pushed together until the concave dimples 18 mate with the convex dimples 24.

In some embodiments, for added stability, a spike or screw 40 is inserted into a secondary recessed bore 16 below one of both of the recessed dimples 18.

Figure 4:
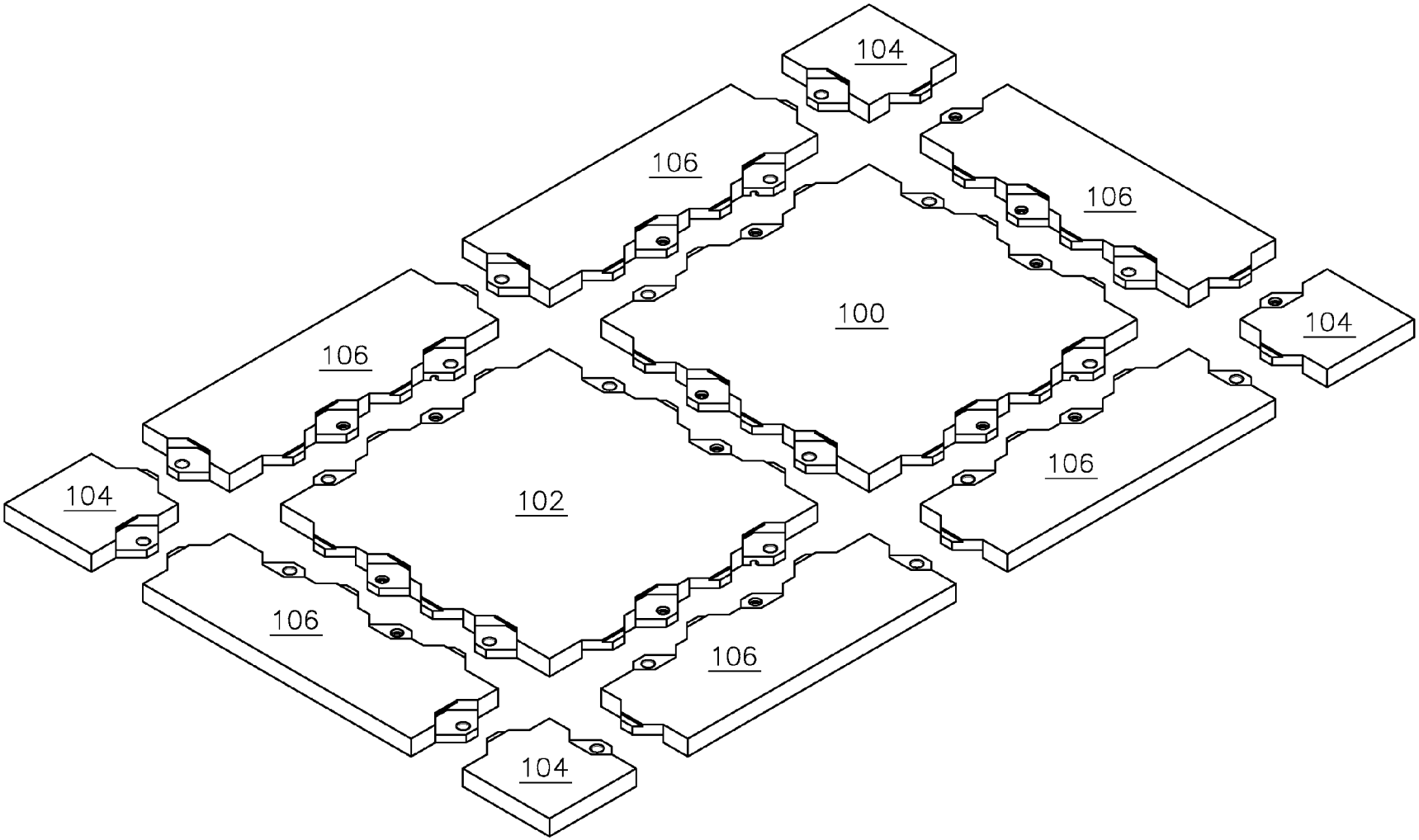
FIG. 4 is a top perspective view of two adjacent polymeric panels of FIG. 1 and flat-edged border panels ready to be interlocked together at their edges.
Figure 5:
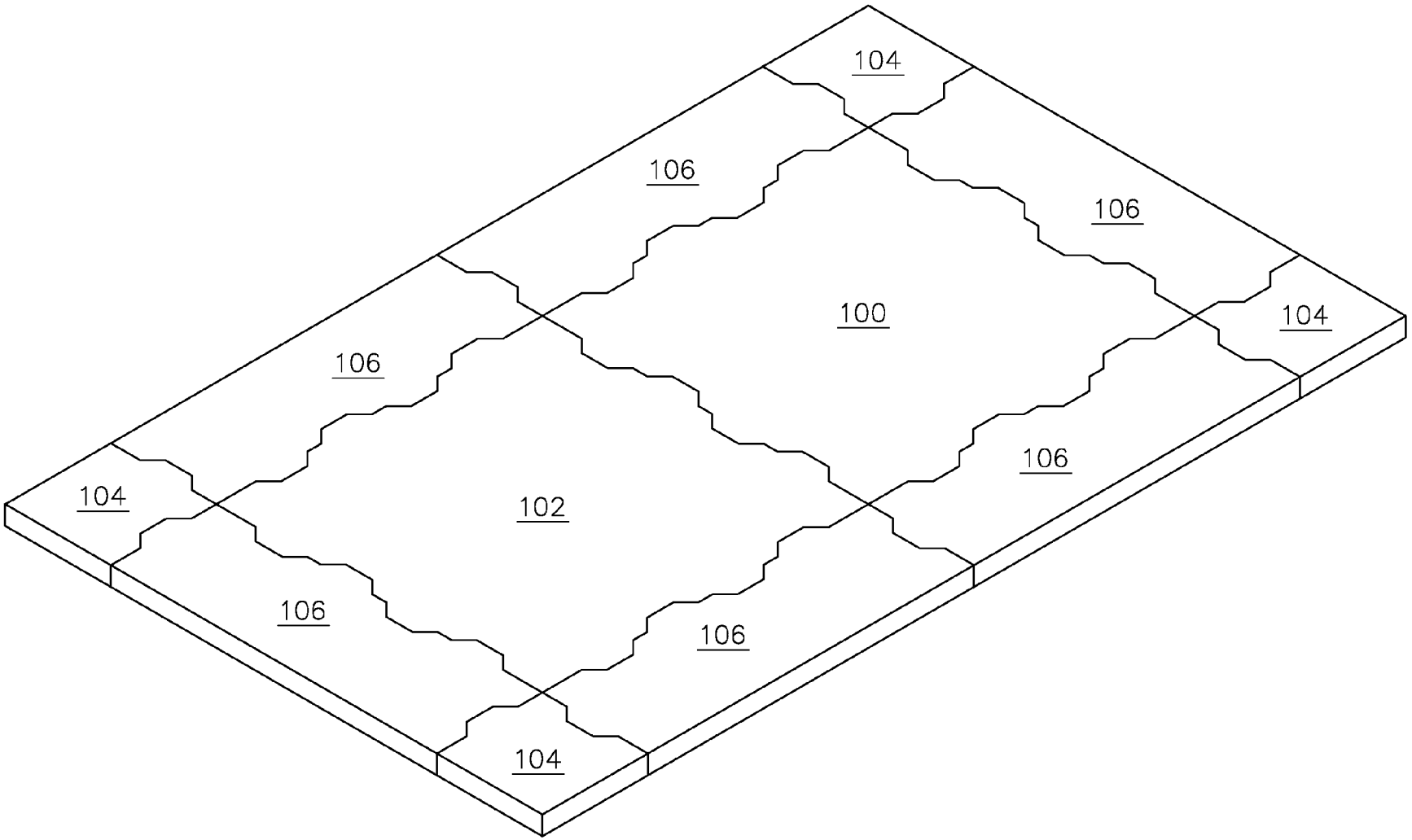
FIG. 5 is a top perspective view of two adjacent polymeric panels of FIG. 1 and flat-edged border panels interlocked together at their edges.

In FIG. 4, two adjacent polymeric panels 100/102 of FIG. 2 are shown prior to being interlocked and shown interlocked in FIG. 5. In this embodiment, the panels 100/102 mate with edge panels 106 and corner panels 104. The edge panels 106 and corner panels 104 have flat or smooth outward facing edges and the same interlock mechanism as the polymeric panels 100/102. The panels 100/102/104/106 are pushed together until the concave dimples 18 mate with the convex dimples 24.

Figure 6:
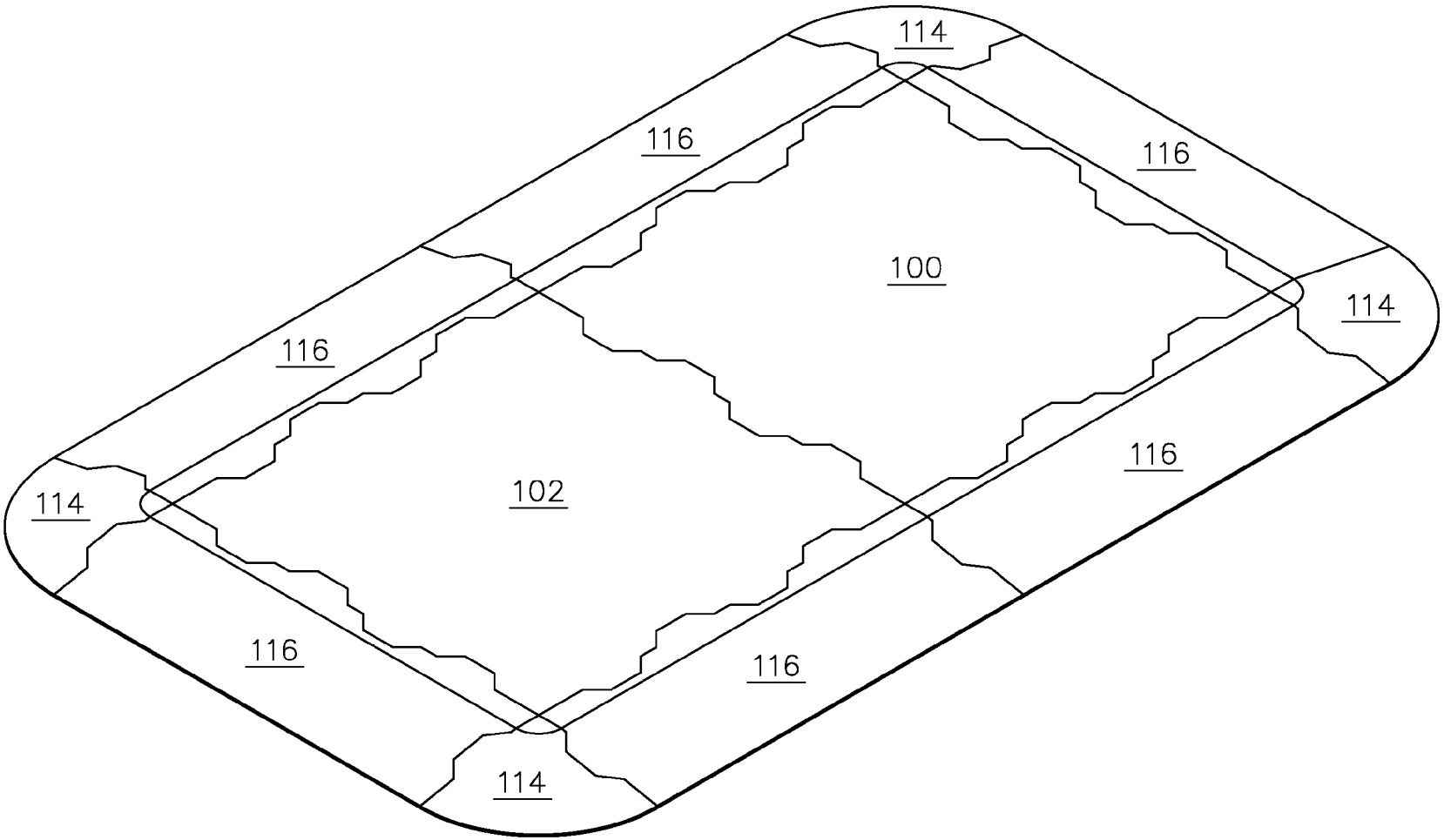
FIG. 6 is a top perspective view of two adjacent polymeric panels of FIG. 1 and round-edged border panels interlocked together at their edges.

Referring to FIG. 6, two adjacent polymeric panels 100/102 of FIG. 1 are interlocked with and round-edged border panels 114/116. The border panels 114/116 of this embodiment have straight (116) or curved edges (114) that taper away from the two polymeric panels 100/102 so as to reduce the chances of tripping over an abrupt edge. In this embodiment, there are side parts 116 that have the same interlock mechanism as the polymeric panels 100/102 to mate directly with the polymeric panels 100/102. The corner parts 114 mate with the side parts 116 in a similar fashion.

Figure 7:
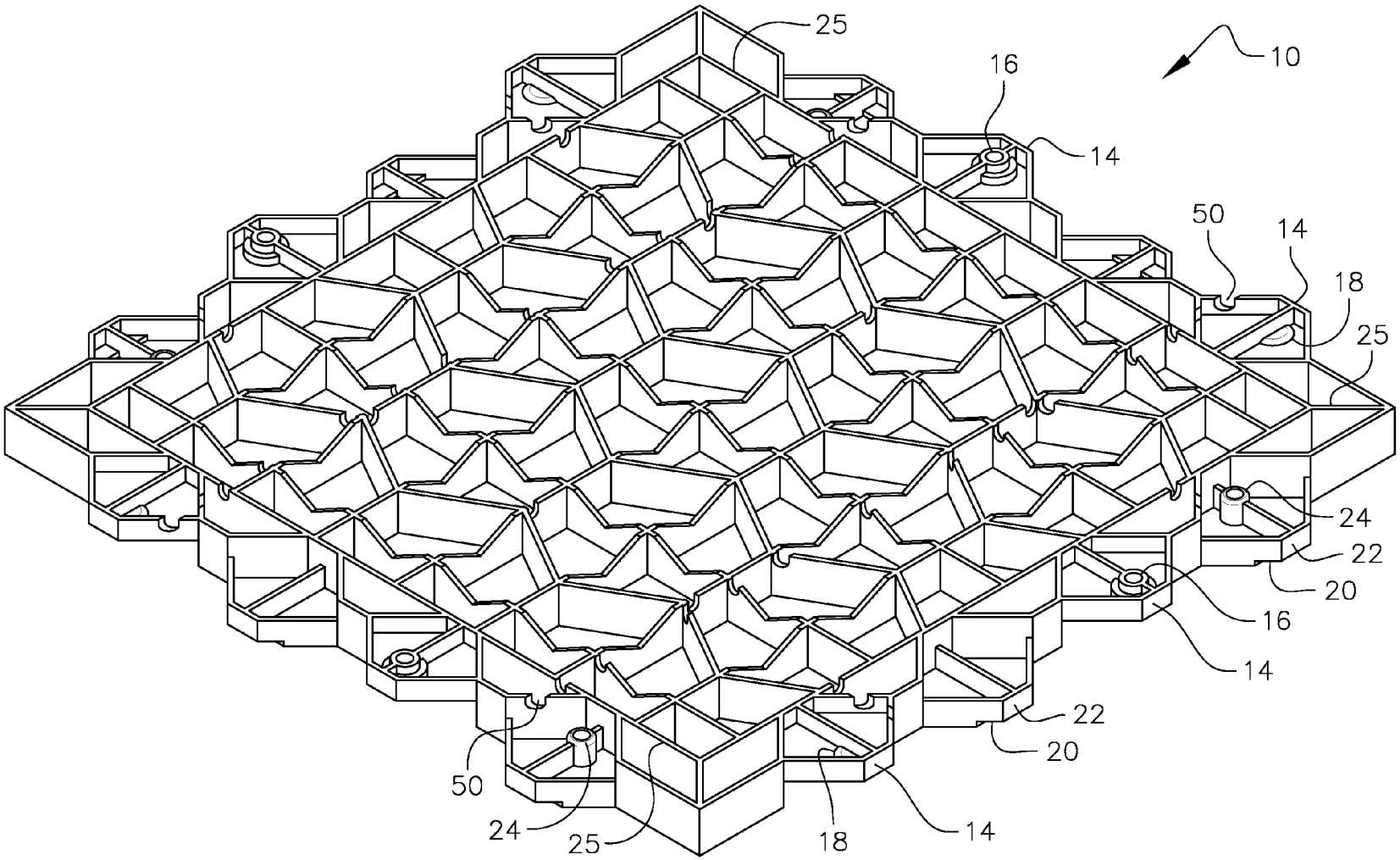
FIG. 7 is a bottom perspective view of a molded polymeric panel shown in FIG. 1.

FIG. 7 shows a bottom perspective view of a molded polymeric panel 10 with a rigid grid structure 25. It is preferred to fabricate the panels with such a grid structure 25, providing strength and durability while keeping weight and material content to a minimum. It is anticipated that other substructures can be substituted without veering from the present invention, including a solid base, honeycombs, etc. In some embodiments, a wire chase 50 is provided to permit running wires, cables and/or drainage between the polymeric panels 10 and a sub floor (not shown). The wire chase 50 is a series of openings allowing a wire and/or liquids (e.g. water) to pass under the grid structure 25 of the polymeric panels 10 without creating unevenness, bumps or damage to the wire.

Figure 9:
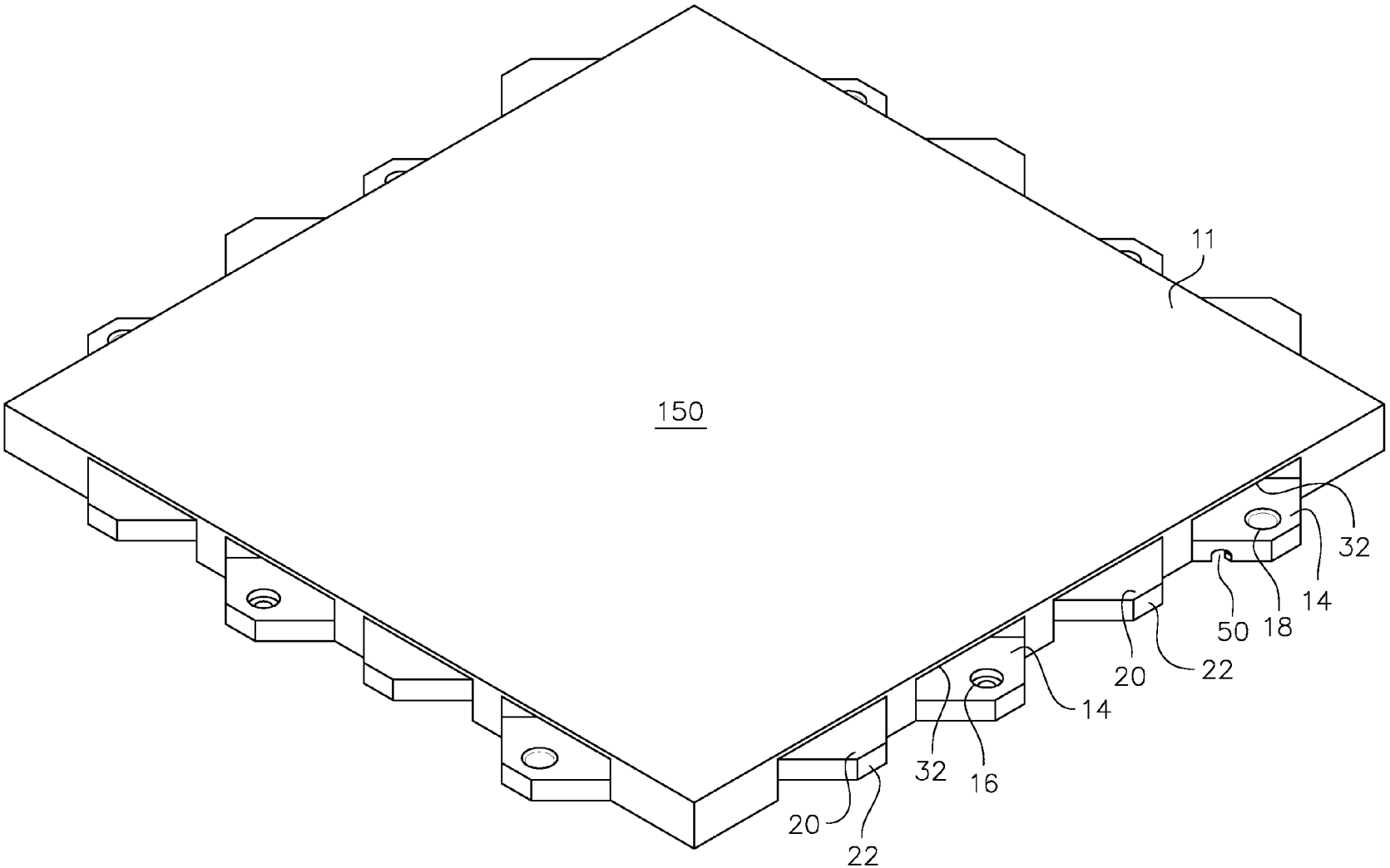
FIG. 9 is a top perspective view of a molded polymeric panel with straight interface edges employed to form the interlocked base or floor system.
Figure 10:
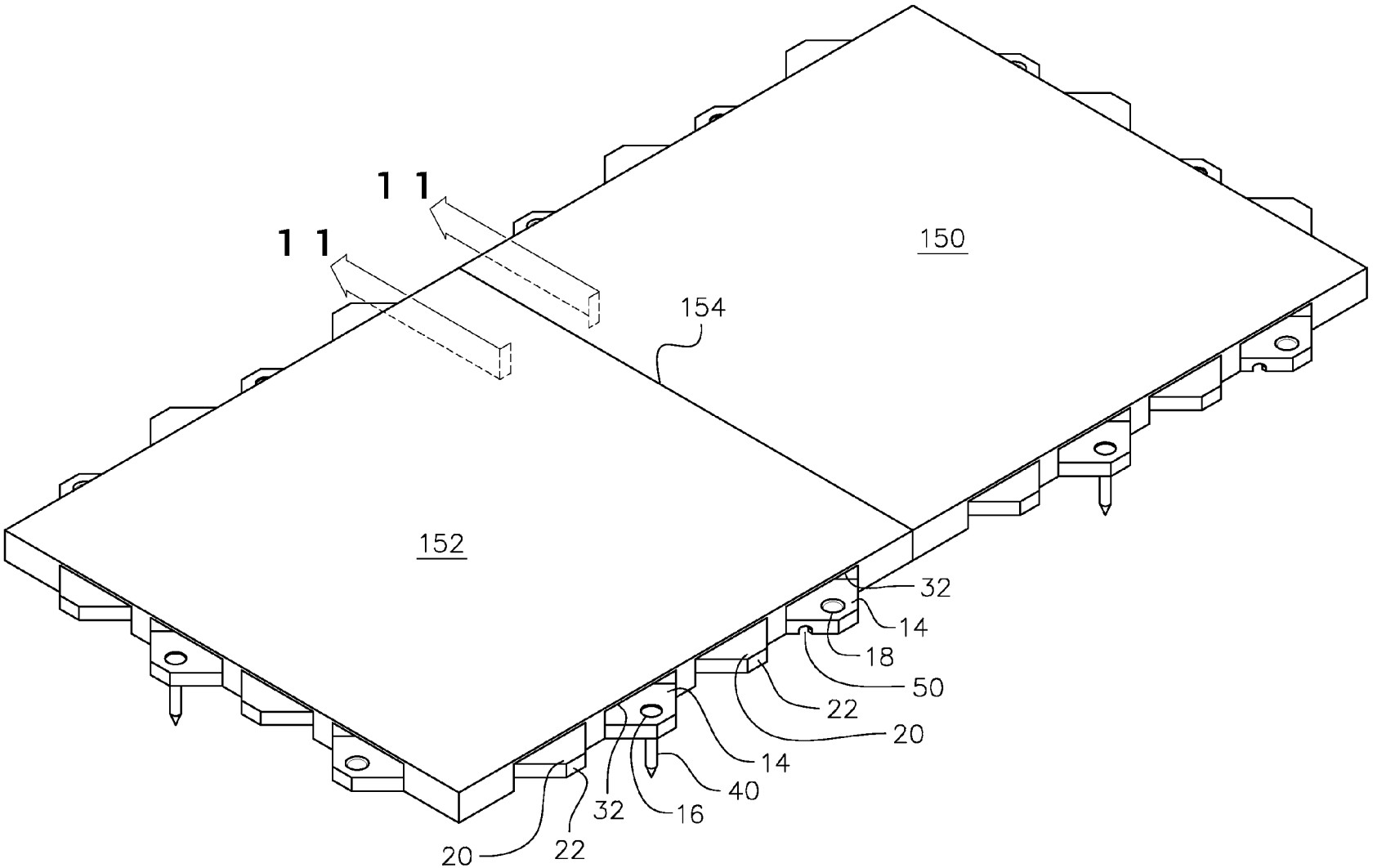
FIG. 10 is a top perspective view of two adjacent polymeric panels of FIG. 9 interlocked together at their edges.
Figure 11:
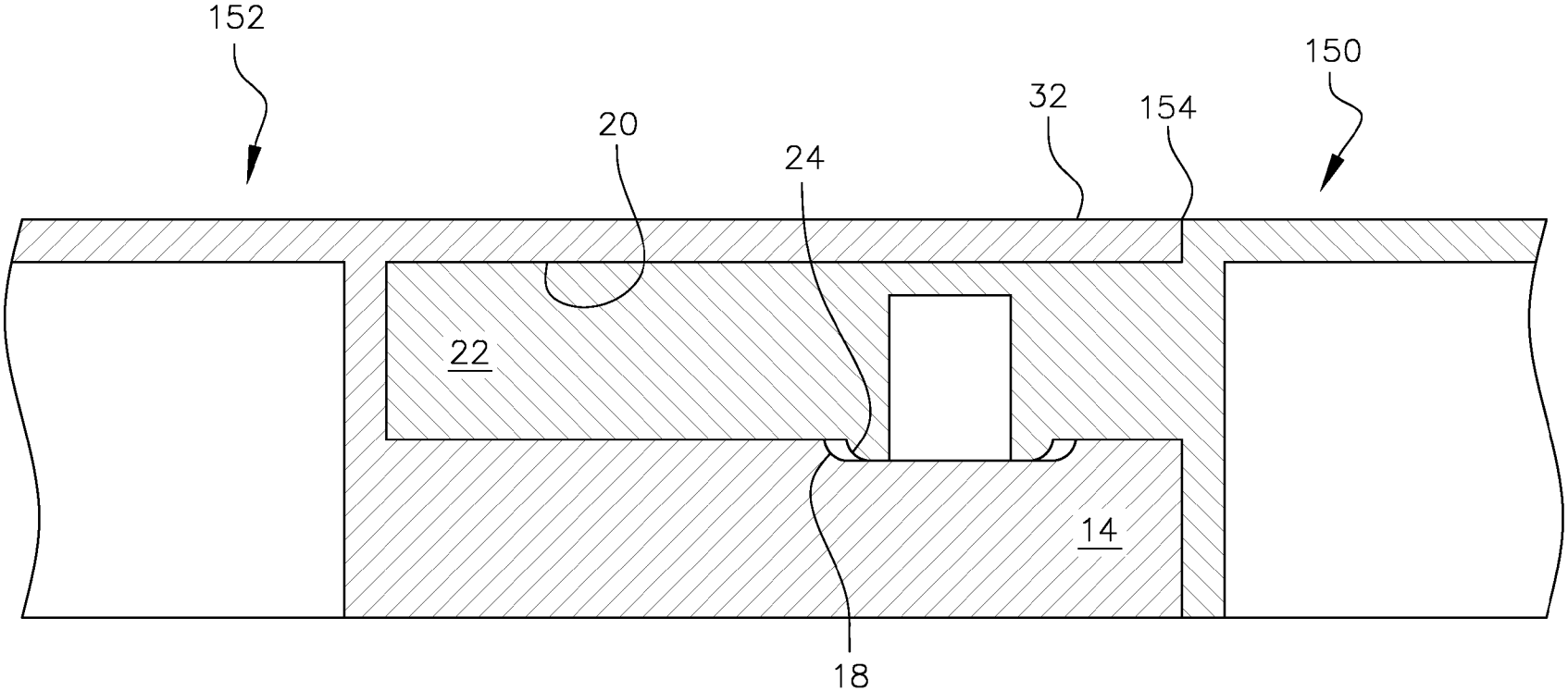
FIG. 11 is a cross-section along line 11-11 of FIG. 10 showing the adjacent polymeric edges in the panels interlocked together.

Referring to FIGS. 9, 10 and 11, panels 150 of a second embodiment join together to form an interlocked series of panels. In this embodiment, the overhang ledge 32 is extended outward from the panel 150 to form a straight edge. Therefore, when joined with other panels 150/152, the interface edge 154 is straight. In this embodiment, the under hang ledge 20 runs the full length of the downward facing step 22. Each panel 150 has upright facing steps 14 and downward facing steps 22. At least one of the downward facing steps 22 contains a downwardly pointing convex projection 24 on lower surface 22. At least one of the upward facing steps 14 contains a mating concave dimple 18 on its upper surface, as shown in FIG. 11. The overhang ledge 32 as shown in FIG. 11 extends outwardly to approximately the same point as the upward facing step 14. The adjacent panels 150/152 are slid together, inserting the downward facing steps 22 between the upward facing steps 14 and the overhang ledge 32, thereby engaging convex projections 24 with concave dimples 18. FIG. 10 shows two panels 150/152 interlocked. The interlock mechanism including the steps, cavities, convex protrusions and concave mating dimples help adjacent panels retain smooth planar alignment with each other in addition to a tight mechanical interlock.

The panels 150/152 can be disengaged by pulling them apart. In a preferred embodiment, the top planar surface 11 of the panel 150 is molded as an integral rigid body with the grid structure 25 shown in FIG. 7.

In embodiments with panels that have more than one pair of steps, it is preferred to configure the panels 150 as shown with the outer steps 14/22 having the mating convex projections 24 and concave mating dimples 18. In some embodiments where the panels are smaller, a single pair of steps 14/22 is sufficient. In some embodiments where the panels are larger, several pair of steps 14/22 is included and more than one pair of steps includes the mating convex projections 24 and concave mating dimples 18.

As in the previous embodiments, the molded integral rigid body with grid structure 25 is made from molded filled or non-filled polymers or any other suitable material including rubber, recycled rubber or any rubber-like material. The polymers can include polypropylene, structural urethane foams or other suitable commercially available polyolefins. The rubber can include processed, recycled automobile tires mixed in a bonding agent.

Figure 12:
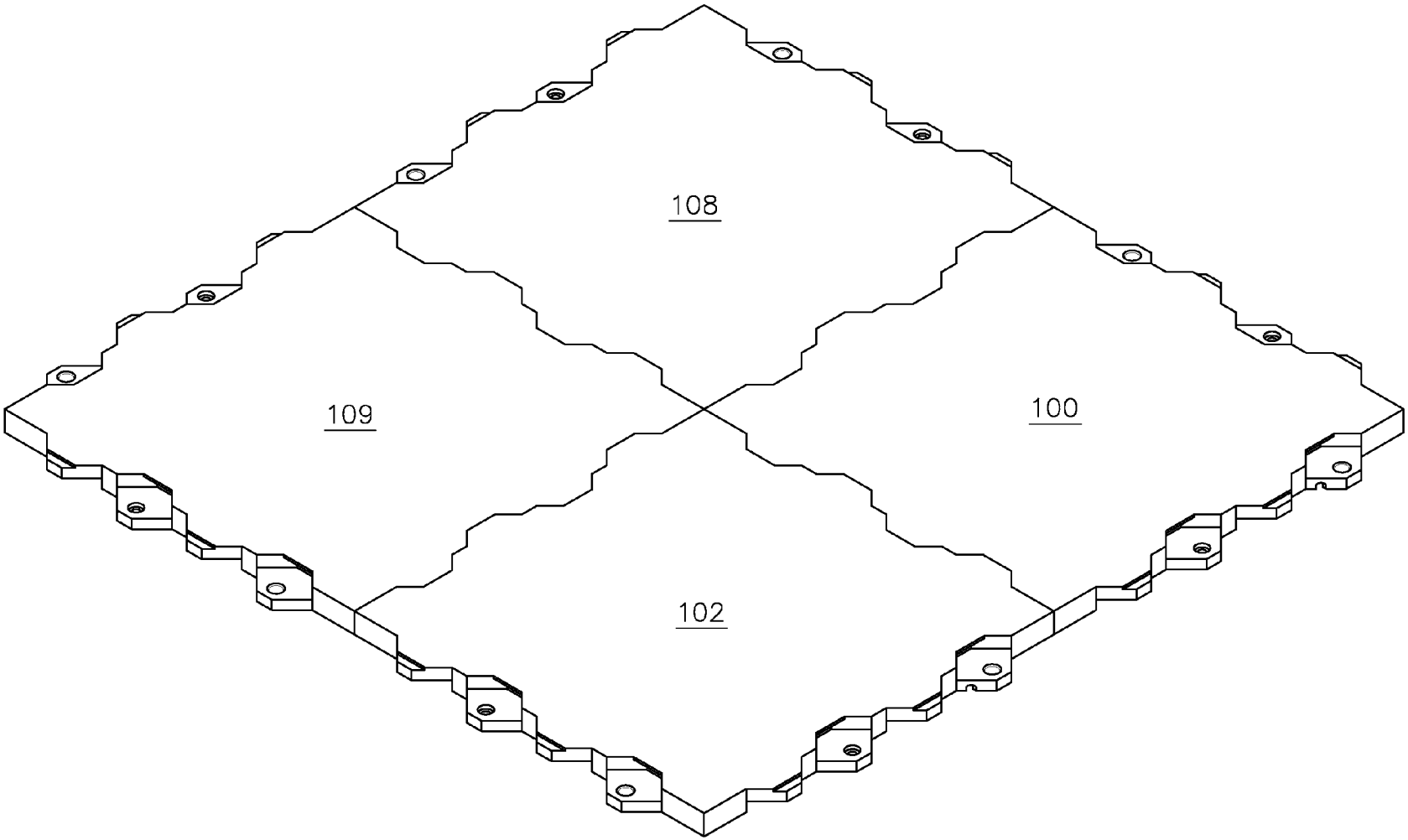
FIG. 12 is a top perspective view of four adjacent polymeric panels of FIG. 1 interlocked together at their edges.

FIG. 12 shows four adjacent polymeric panels 100/102/108/109 of FIG. 1 interlocked together as described in FIGS. 10 and 11.

Figure 13:
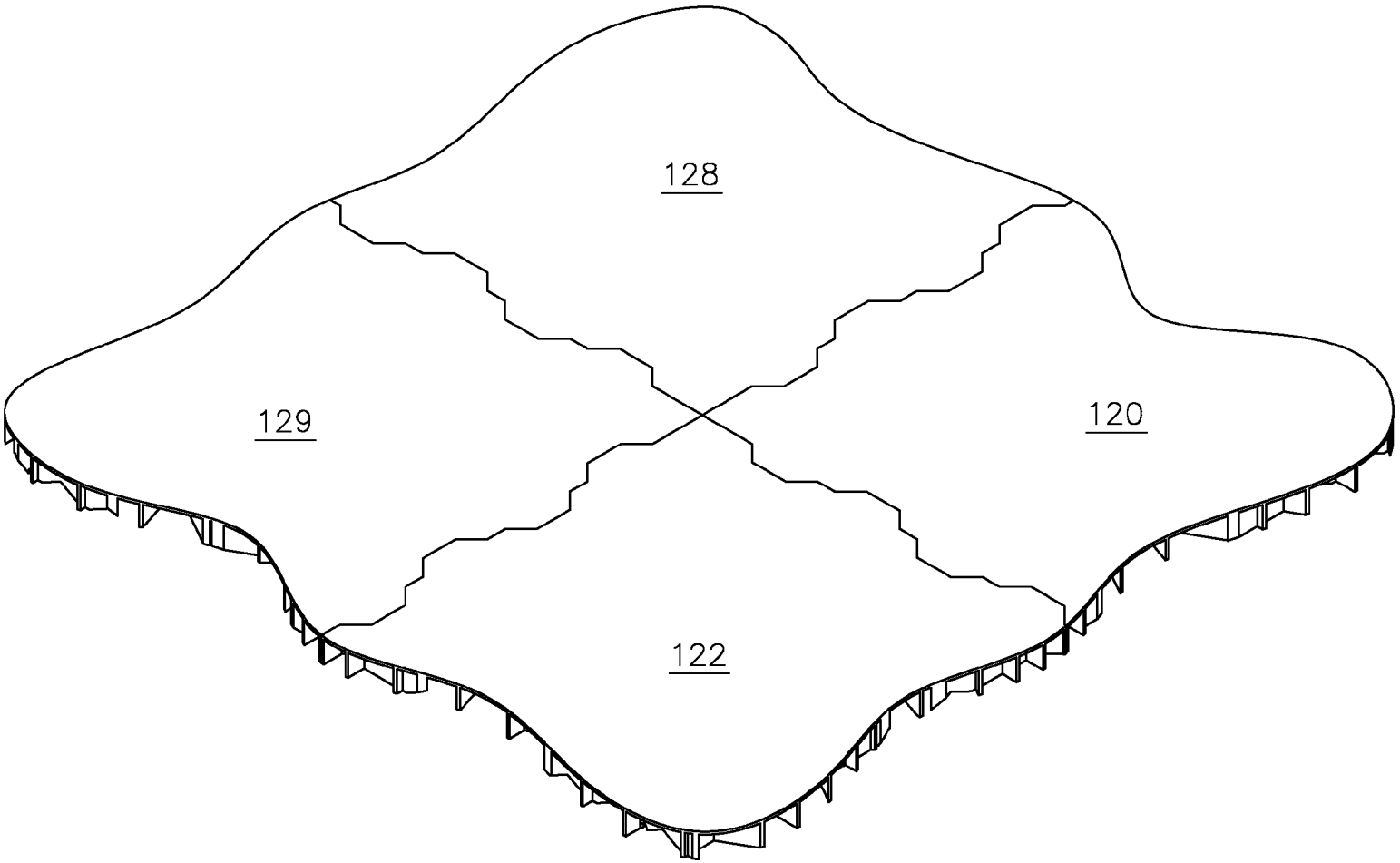
FIG. 13 is a top perspective view of four adjacent polymeric panels with curved outer edges interlocked together at their edges.

FIG. 13 shows four adjacent polymeric panels with curved outer edges 120/122/128/129 interlocked together as described above. These panels 120/122/128/129 are either fabricated with smooth or curved outer edges or are cut to shape during installation.

Figure 14:
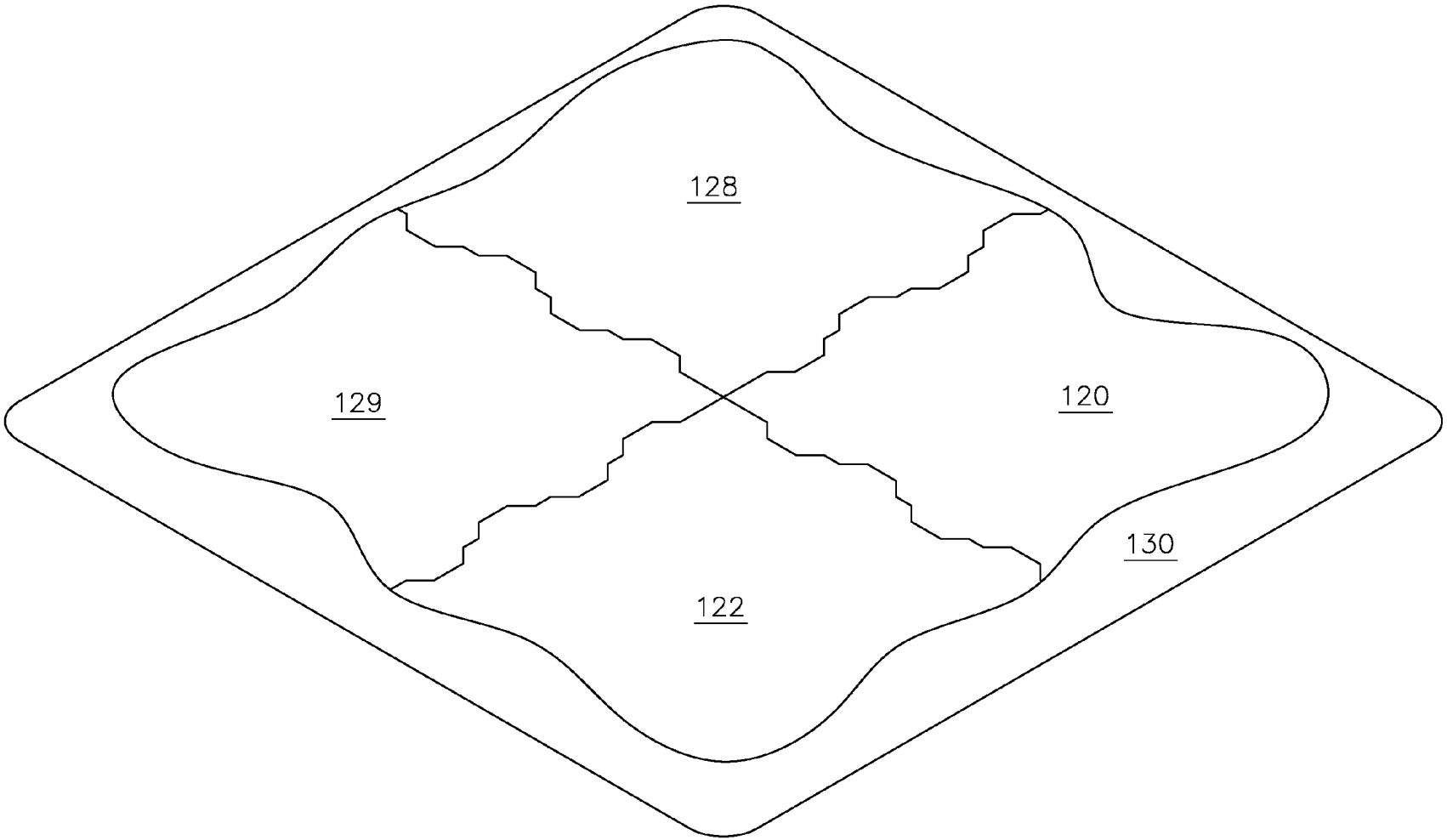
FIG. 14 is a top perspective view of four adjacent polymeric panels of FIG. 13 interlocked together at their edges enclosed within a border.

FIG. 14 shows four adjacent polymeric panels with curved outer edges 120/122/128/129 interlocked together as described above enclosed within a border 130. The border 130 is, for example, a molded border shaped to the contour of the outer edges of the curved panels 120/122/128/129, or an area of sand, dirt or concrete that is backfilled around the panels 120/122/128/129 as in a patio arrangement.

Figure 15A:
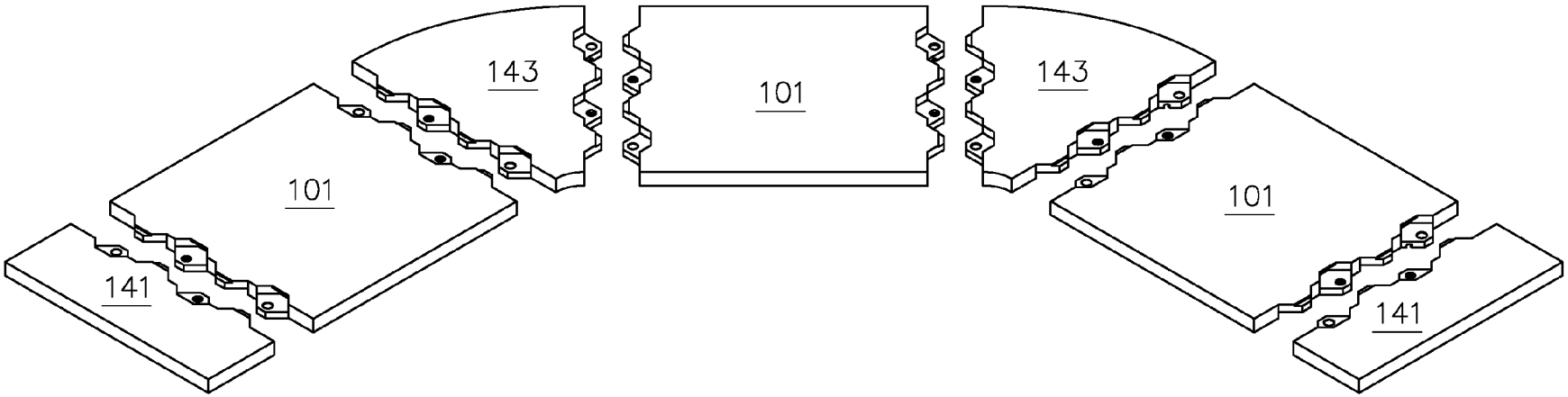
FIG. 15A is a top perspective view of polymeric panels customized to form a sidewalk, ready to be interlocked together at their edges.

FIG. 15A shows the basic interlock mechanism of FIG. 1 with polymeric panels 101/141/143 customized to form a sidewalk. These panels 101/141/143 have the interlock mechanism of the present invention at one side or two opposing sides and have smooth straight or curved edges on the remaining sides. Multiple panels 101/141/143 can be arranged to provide various lengths and configurations of walkways or sidewalks.

Figure 15B:
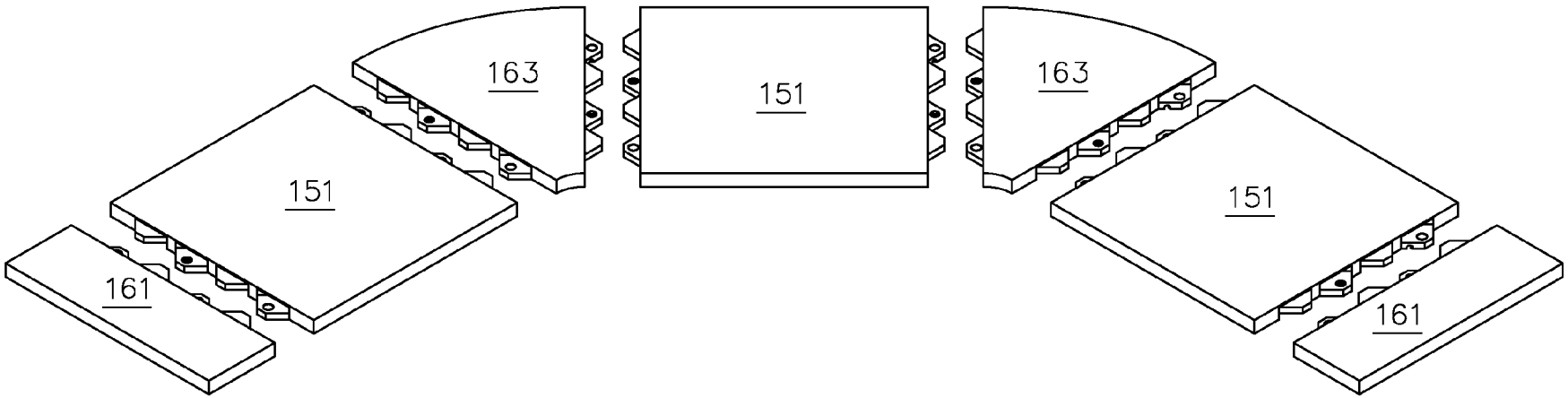
FIG. 15B is a top perspective view of polymeric panels with flat interfacing edges customized to form a sidewalk, ready to be interlocked together at their edges.

FIG. 15B shows the basic interlock mechanism of FIG. 9 with polymeric panels 151/161/163 customized to form a sidewalk with straight interface lines. These panels 151/161/163 have the interlock mechanism of the second embodiment of the present invention (FIG. 9) at one side or two opposing sides and have smooth straight or curved edges on the remaining sides. Multiple panels 151/161/163 can be arranged to provide various lengths and configurations of walkways or sidewalks.

Figure 16A:
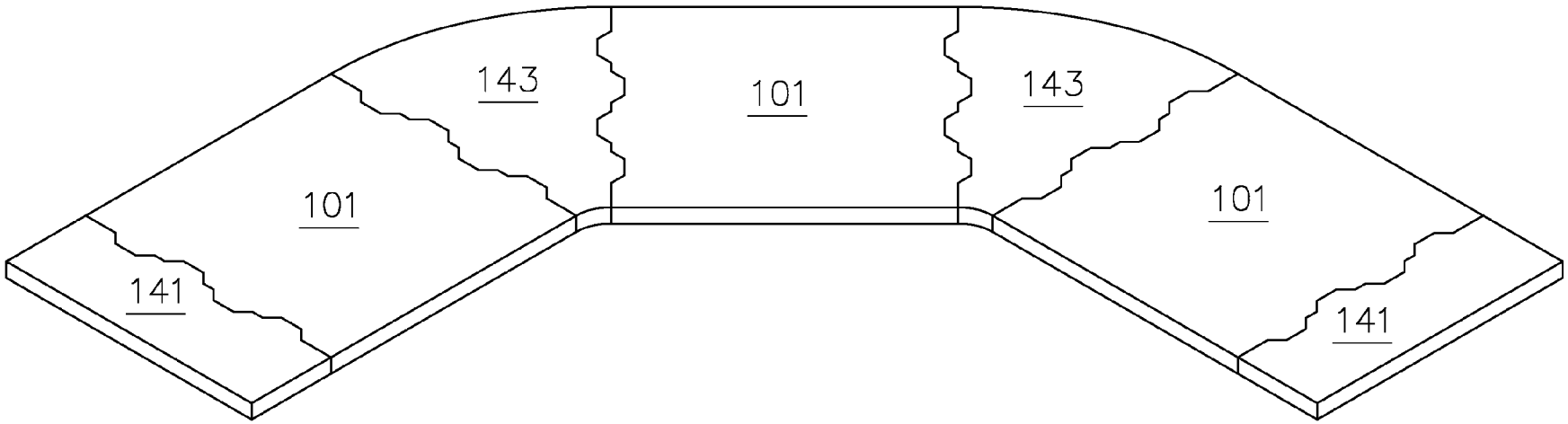
FIG. 16A is a top perspective view of polymeric panels of FIG. 15A customized to form a sidewalk, interlocked together at their edges.

FIG. 16A shows the panels 101/141/143 of FIG. 15A interlocked together at their edges.

Figure 16B:
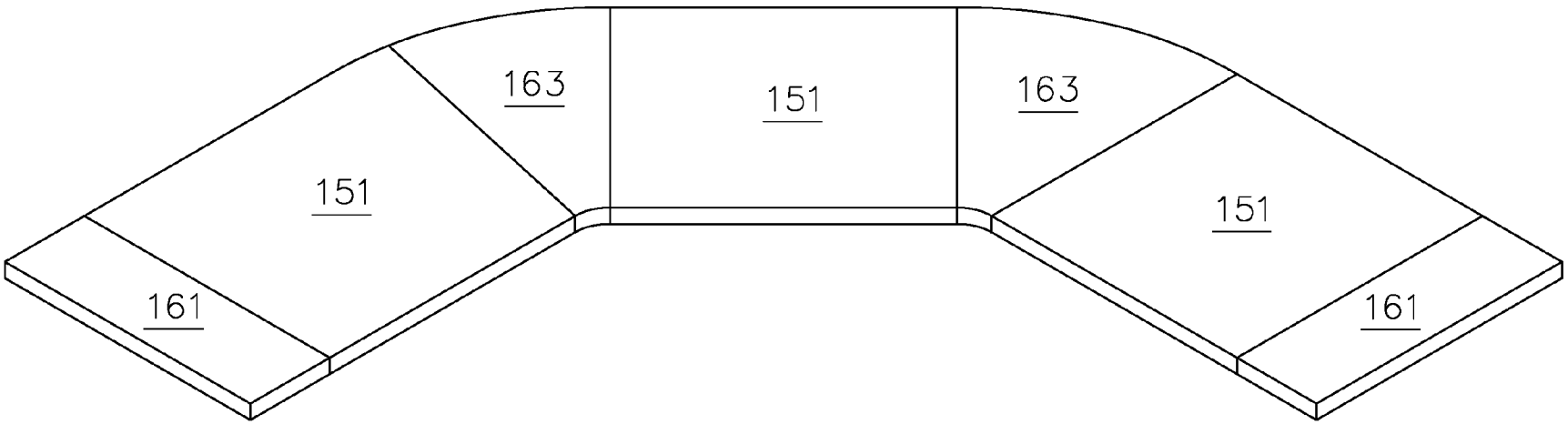
FIG. 16B is a top perspective view of polymeric panels of FIG. 15B with flat interfacing edges customized to form a sidewalk, interlocked together at their edges.

FIG. 16B shows the panels 151/161/163 of FIG. 15B interlocked together at their edges.

Figure 17:
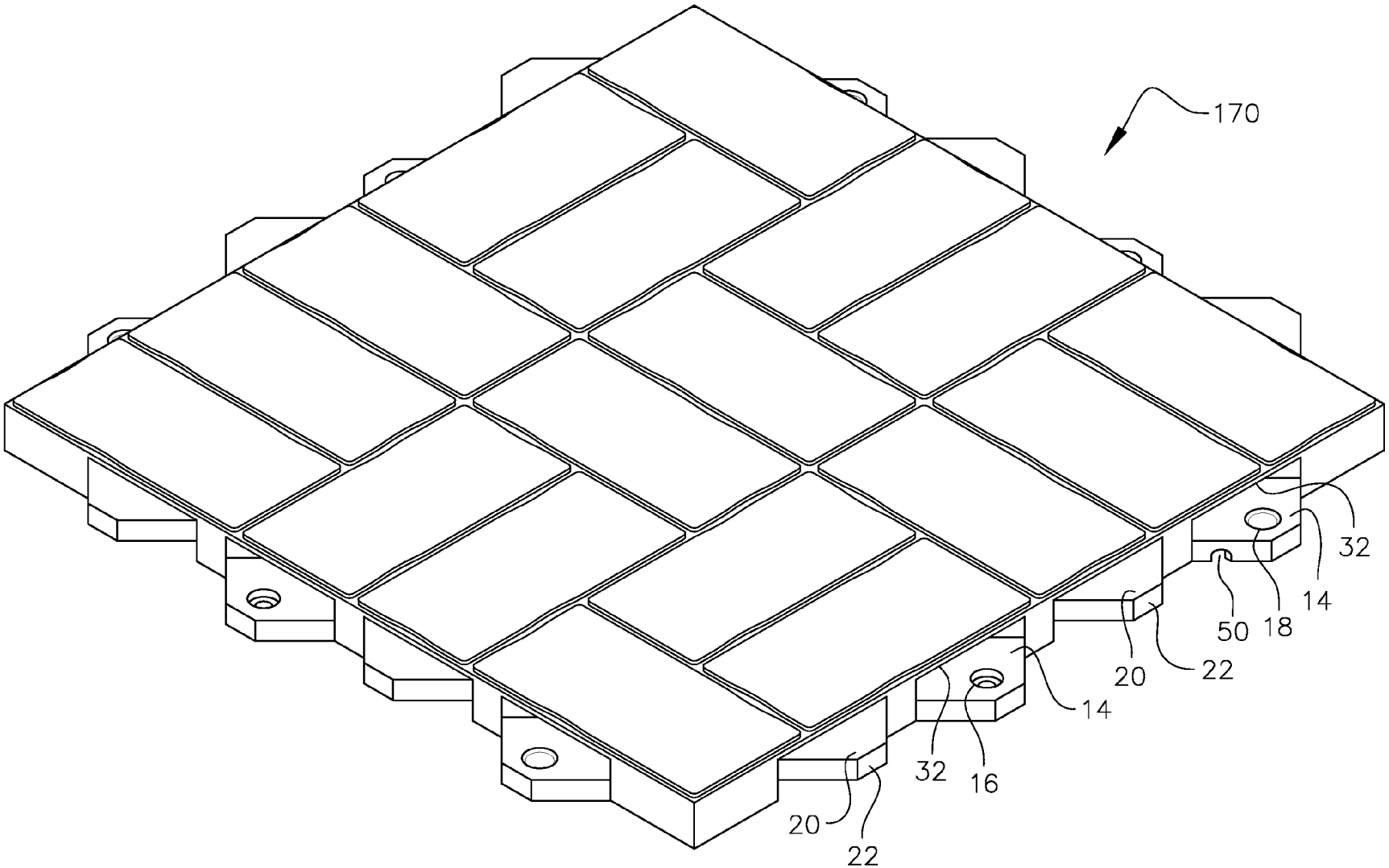
FIG. 17 is a top perspective view of polymeric panels of FIG. 9 with a brick-face decorative top.

FIG. 17 shows the polymeric panels of FIG. 9 with a brick-face decorative top 170. The panels of the present invention are deployable with a plain surface, with a decorative surface as in FIG. 17 or with a covering surface such as carpet, linoleum, vinyl, wood, synthetic wood, tile or artificial turf. FIG. 17 shows a brick-shaped top, one example of the many different decorative tops that are possible with the present invention. It is equally viable to affix a brick façade and grout on top of a panel with a plain, planar surface to achieve a similar look and shape with the feel of real brick.

Figure 18:
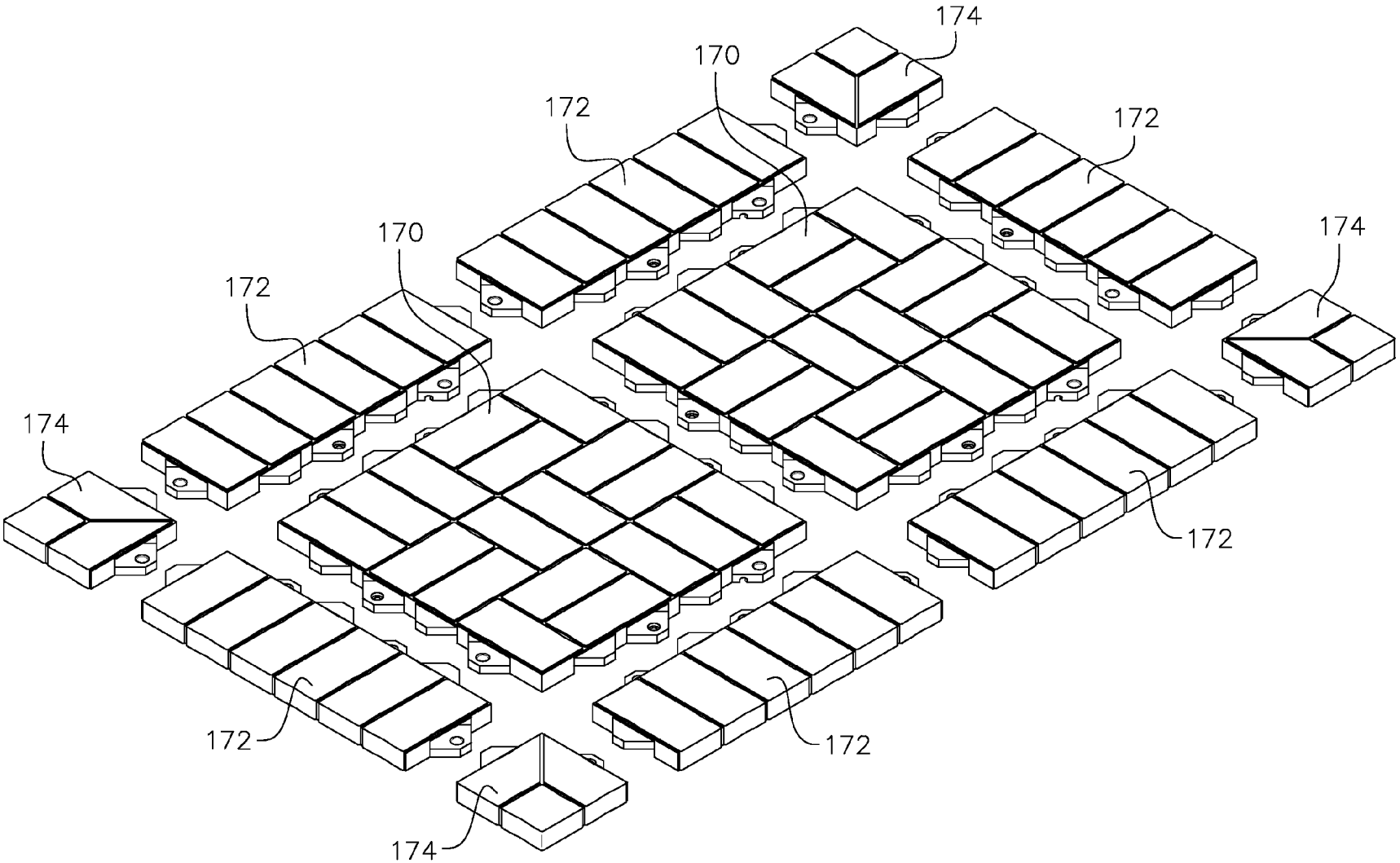
FIG. 18 is a top perspective view of multiple polymeric panels of FIG. 17 along with end-caps, all having a brick-face decorative top and ready to be interlocked.

FIG. 18 shows multiple polymeric panels 170 of FIG. 17 along with end-caps 172/174, all having a molded brick-face decorative top and ready to be interlocked. The end-caps 172/174 utilize the same system to interlock.

Figure 19:
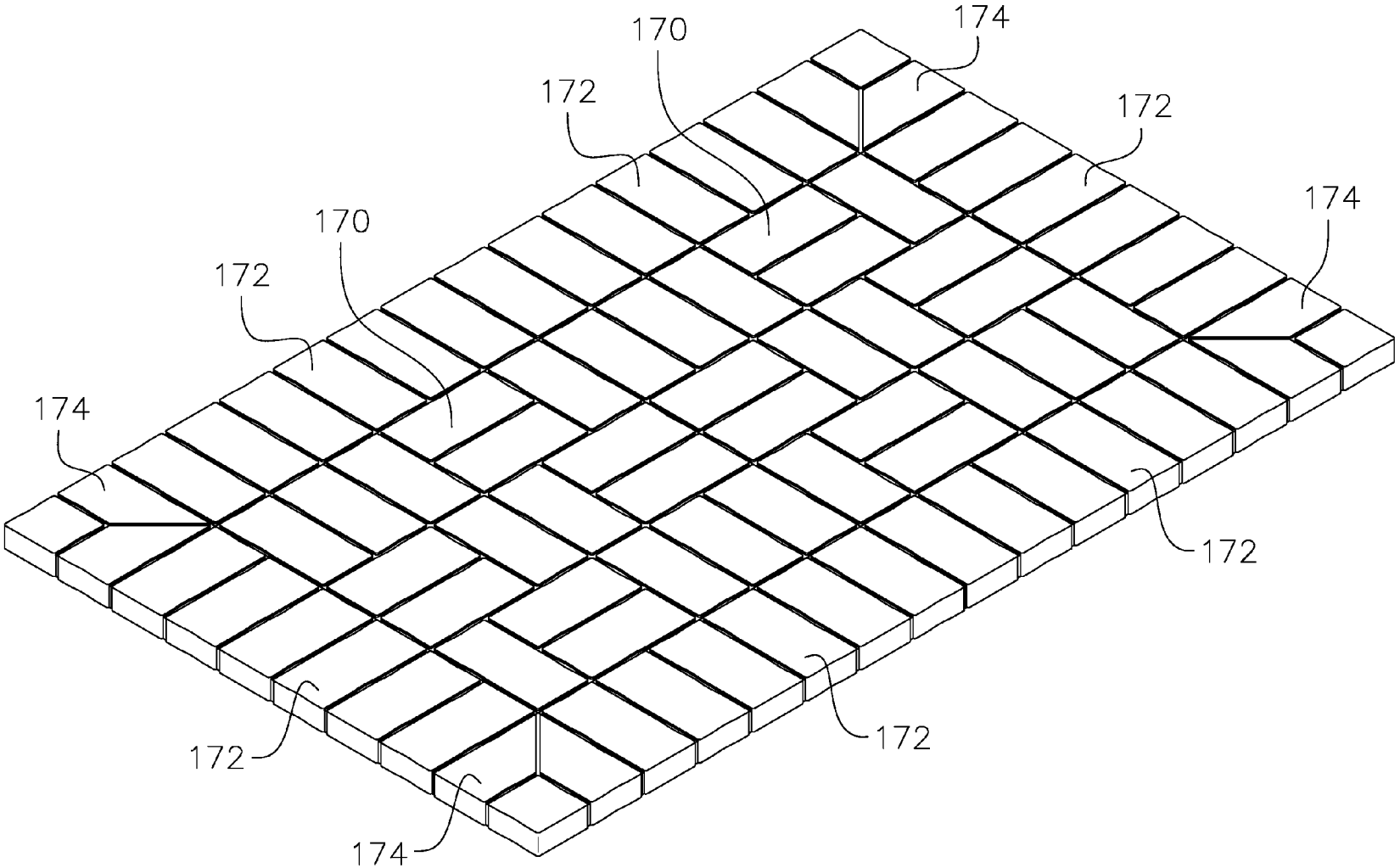
FIG. 19 is a top perspective view of multiple interlocked polymeric panels of FIG. 17 with end-caps, all having a brick-face decorative top.

FIG. 19 shows the multiple polymeric panels 170 and end-caps 172/174 of FIG. 17 interlocked, forming a patio or deck.

Figure 20:
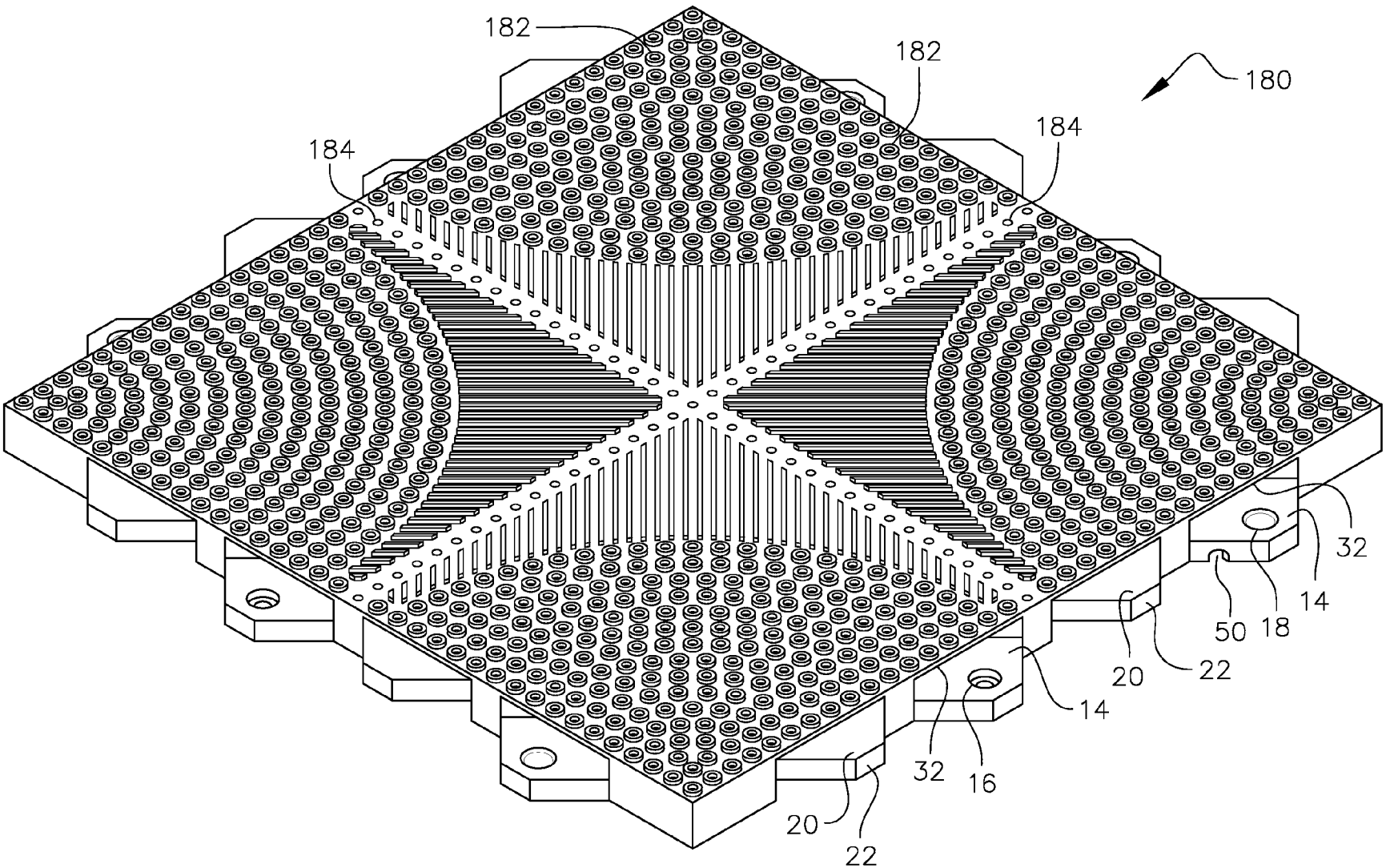
FIG. 20 is a top perspective view of polymeric panels of FIG. 9 with a safety top.

FIG. 20 shows a polymeric panel of FIG. 9 with a safety top having molded projections 182 pointing upward from a top surface. The safety projections 182 are molded into the panel 180 or molded separately and affixed to the top surface of the panel 180 during manufacturing or installation. If the safety surface is molded into the top surface of the panel 180, it is preferred that the panel and/or the safety surface be molded from a non-skid material such as rubber or a rubber-like material. In some embodiments, drain holes 184 are provided to reduce rain-water build-up.

Figure 21:
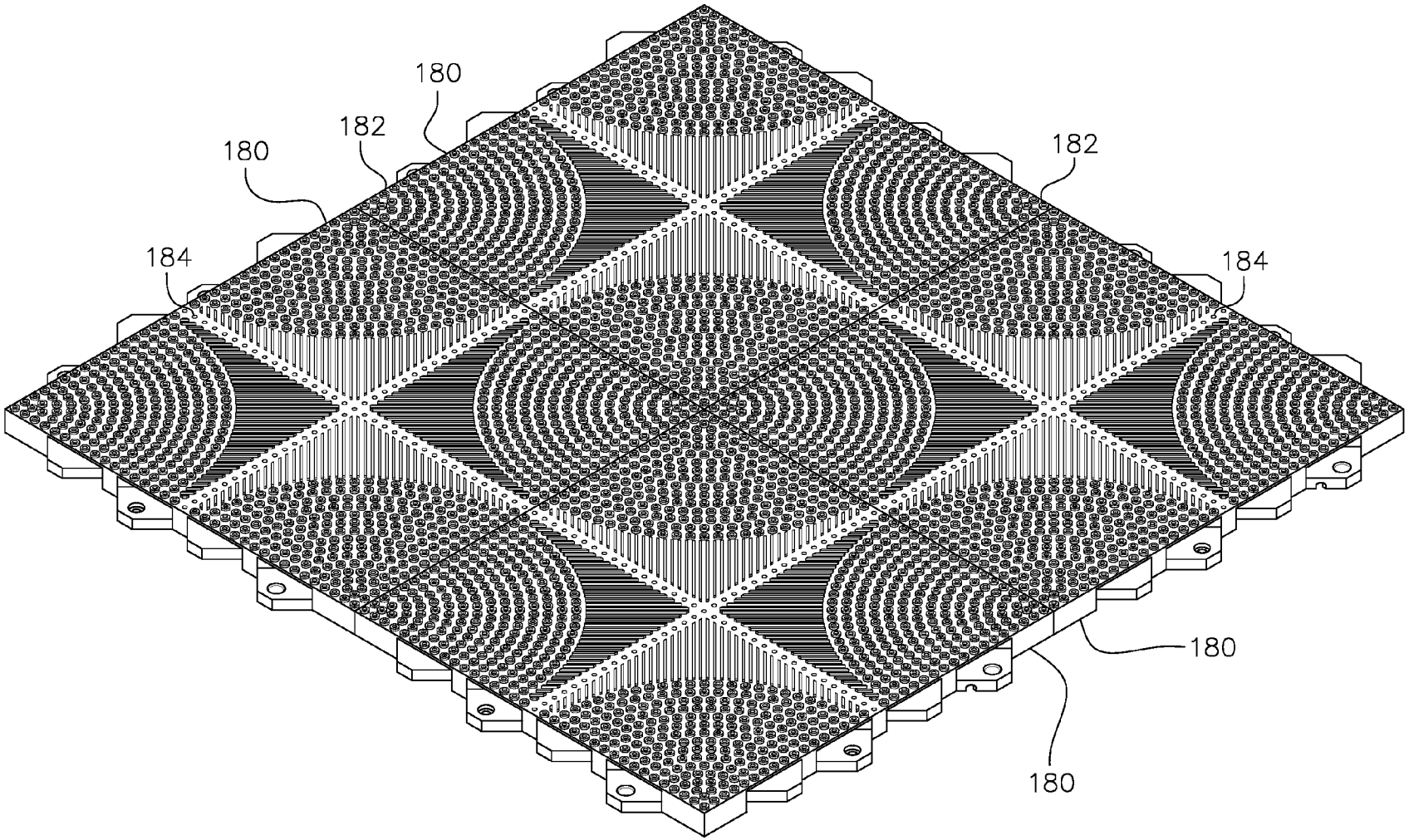
FIG. 21 is a top perspective view of multiple interlocked polymeric panels of FIG. 20 with a safety top.

FIG. 21 shows four interlocked polymeric panels of FIG. 20 with molded projections 182 pointing upward. As shown, when many panels 180 form a safety surface in an area subject to rain or sprinkling, the optional drain holes 184 help prevent water build-up on the top surface.

In one embodiment, interlocked panels 10 with a synthetic grass covering can be used on driving ranges or practice facility for a golf ball hitting area. The configuration of interlocked panels 10 can be longitudinal, squared, rectangular or other geometric or irregular shape, and can be used, for example, outdoors over grass, dirt or sand or indoors over concrete, ice or plywood or as a substitute for a concrete or plywood base. The interlocked panels 10 can be covered with commercially available surfaces, such as SPORT COURT™ athletic floor tiles, hardwood flooring, synthetic wood floor, carpet or linoleum that are easily installed over the interlocked panels and can be removed and reassembled at alternate locations.

Figure 22:
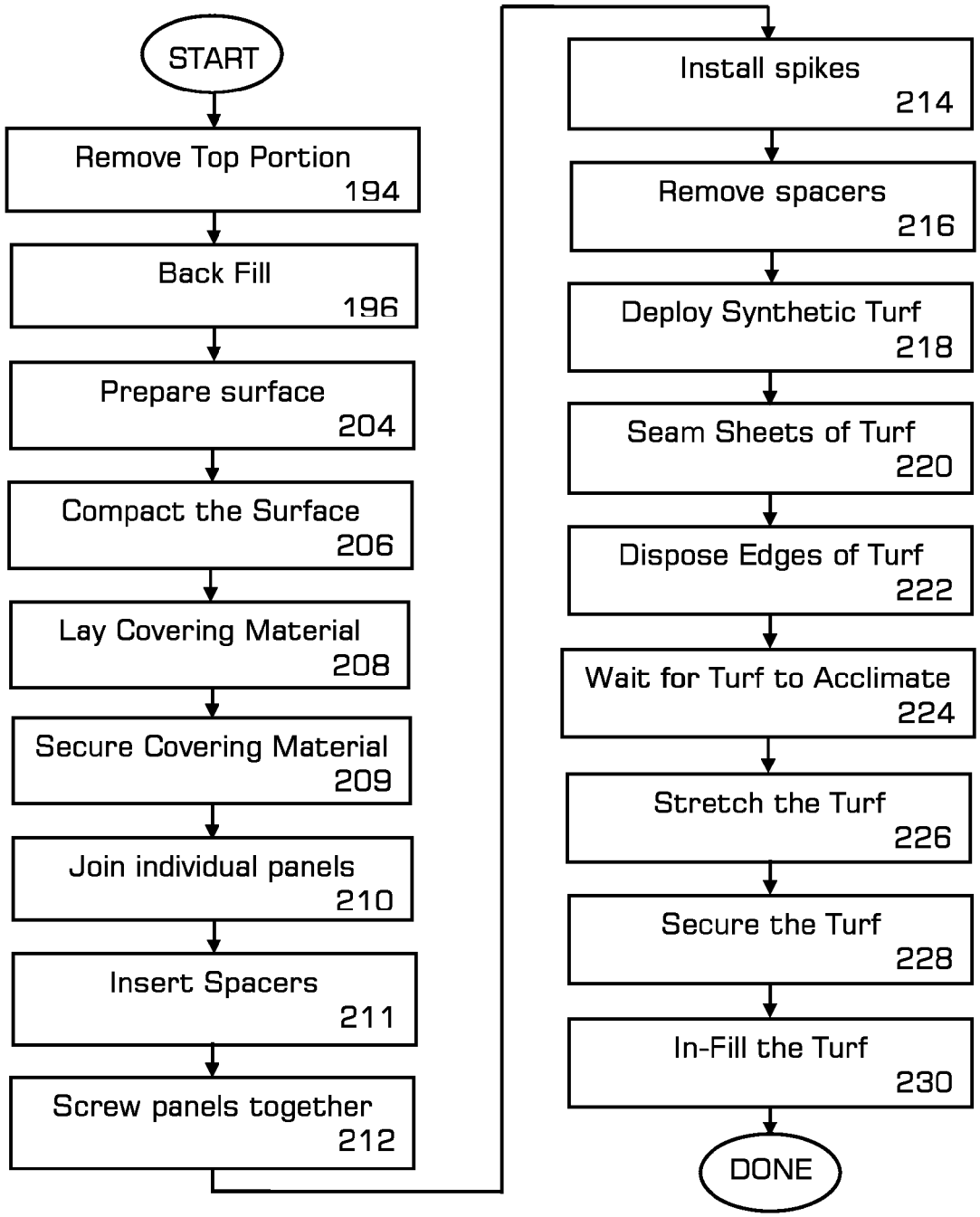
FIG. 22 is a first flow chart of a method of installing the surface of the present invention.

Referring to FIG. 22, a first flow chart of a method of installing the surface of the present invention is described. The first step is to remove a percentage of the existing surface 194. Next, a more suitable material is back-filled 196 to create firmness when compacted and to improved drainage. Typical field installations require between 6 inches and 18 inches of earth removal depending on drainage and frost heave. The depth of excavation required is decided by the installer and the soil engineers.

The field profile and surface is then prepared 204 as required by the site engineer. For example, the field is crowned, as in typical American football or leveled as in a typical soccer field. The preparation includes any needed water pitch and drainage such as perimeter drain collection areas, underground collection containers or straight percolation into the ground. The site engineers typically design the field profile and surface for rain water management.

Once the field profile has been achieved, the area is compacted 206. The compacting 206 produces a firm, smooth area.

Next, a material is laid on the prepared earth 208 and secured to the ground 209 with spikes. Typically, this material is either a pervious or non-pervious geo textile and is determined based on the installation site soils, environmental characteristics and methodology of storm water management.

Next, the interlocked panels 10 of the present invention are installed. This installation includes joining the interlocking interlocked panels 10 of the present invention 210, optionally inserting gap spacers 211 creating a predetermined gap width between the interlocked panels 10 to allow for the proper expansion and contraction that is typical with the selected polymers. Other methods of creating a predetermined gap width between the interlock panels 10 are anticipated including using any object of suitable size to urge the interlock panels 10 apart, for example, a screw driver, etc. If a tapered edge is required, the joining of the interlocking panels 10 includes joining of tapered edge interlocked panels 10 along the outermost edge, thereby creating a slight ramp up to the interlocked panels 10. Other interlocked panels 10 with various edge configurations are anticipated as well.

Note that the interlocked panels 10 allow water to pass either through drainage holes 184 (see FIGS. 20 and 20) or through the gaps between the interlocked panels 10. Water beneath the interlocked panels 10 is permitted to move laterally (approximately horizontally) beneath the interlocked panels 10 through the wire chases 50 in the bottom ribs of the interlocked panels 10.

The outside perimeter interlocked panels 10 are optionally screwed together using fasteners such as self-tapping screws 212. The fasteners are left slightly loose to allow for expansion.

Next, if spikes are needed, the spikes 40 (see FIGS. 2 and 3) are driven (installed) 214 through the existing screw holes 18 along the outside perimeter of the interlocked panels 10. The spikes, for example, are made from stainless steel, plastic or other suitable material. It is recommend, but not required, to install a spike every 3 to 4 interlocked panel 10. When used, the spikes 40 reduce movement of the interlocked panels 10 within the confines of the interlocked panel system and prevent expansion of the overall size during heating/cooling.

Next, the spacers are removed 216.

Next, a sheet of synthetic turf is now rolled out 218 on to the interlocked panels 10. There are many types of turf such as polypropylene, polyethylene, nylon or combinations thereof. The synthetic turf typically includes a hacking system, but this is not required. Some hacking systems have anti slip backing while others do not. If multiple sheets of synthetic turf are needed, the sheets of synthetic turf are seamed together 220 using existing methods such as sewing, hook and loop connections, hot melt glue, tape and seam cloth, and chemical glues.

Once the sheet(s) of synthetic turf have been rolled out and seamed together, the edges of the sheet(s) of synthetic turf are disposed 222. If desired, the edges of the sheet(s) of synthetic turf are left as a loose lay installation. Alternately, the edges of the sheet(s) of synthetic turf are buried the ground around the perimeter of the field, typically buried in around 6 inches of ground (e.g., soil, pebbles, etc.)

If needed, the sheet(s) of synthetic turf are affixed 224 to the interlocked panels 10. The preferred method of affixing is to wait for the sheet(s) of synthetic turf to acclimate 224 to the weather (typically 24 hours but any amount of time is anticipated, including one second), then stretching 226 the synthetic turf to make it flat then securing 228 the synthetic turf to the interlocked panels 10 along the perimeter. It is preferred to install staples though the synthetic turf and into the interlocked panels 10, preferably with a pneumatic stapler or other staple device. It is preferred to staple at intervals of every several inches around the perimeter working from one side of the field to the other while pulling the synthetic turf tight as progress is made.

If needed, after the synthetic turf is installed, the field is in-filled 230 to create ballast in the synthetic turf. Accepted methods of infilling include sand, rubber infill, rubber coated sand or combinations. Other infill products are anticipated in the present invention.

Figure 23:
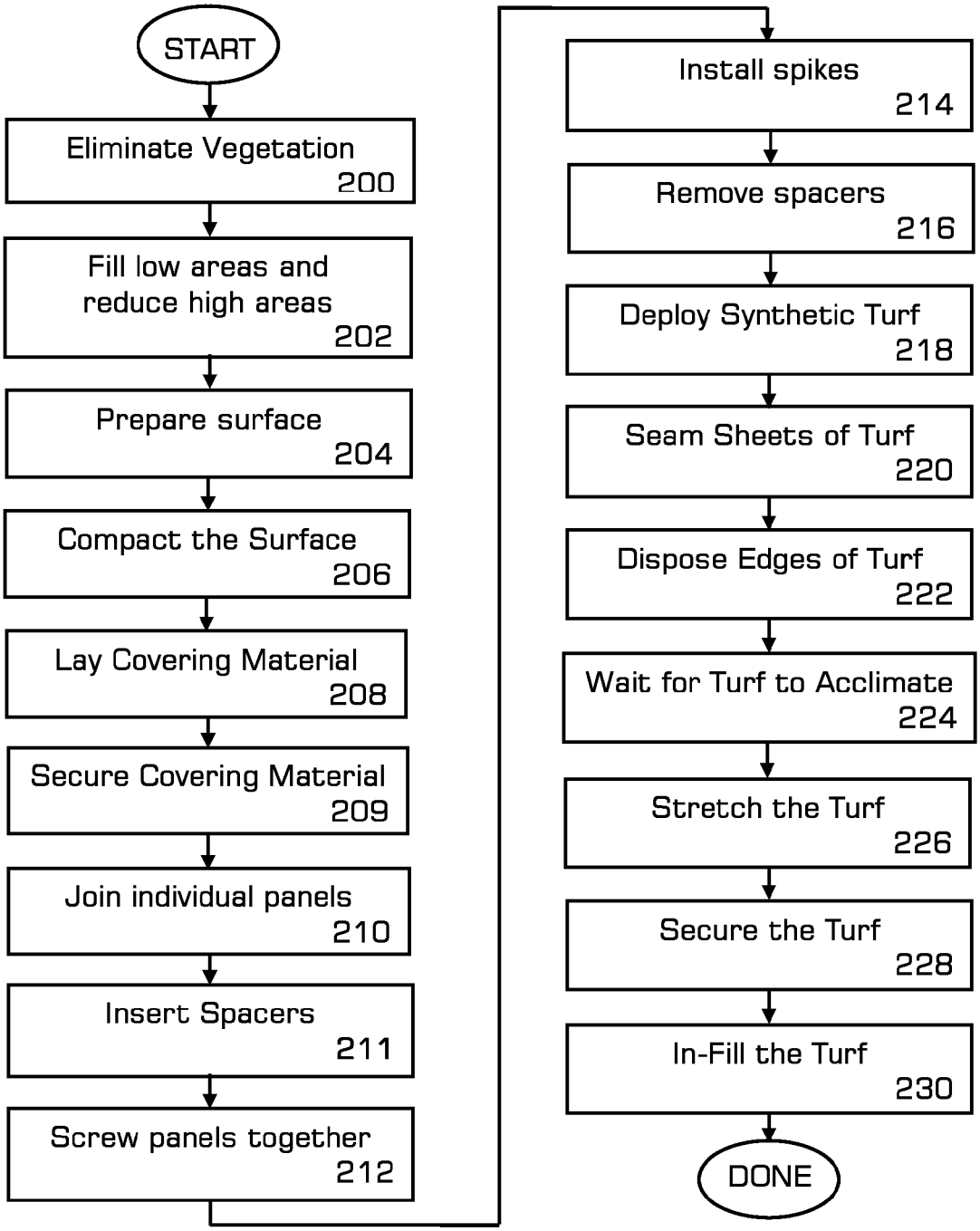
FIG. 23 is a second flow chart of a method of installing the surface of the present invention.

Referring to FIG. 23, a second flow chart of a method of installing the surface of the present invention is described. The vegetation on the existing area such as an existing grass field is eliminated 200. This is done as known in the industry including, but not limited to, killing the vegetation with a weed-killing agent or scalping the vegetation down to the dirt level.

Once the vegetation has been eliminated, any low areas are filled and any high areas are reduced to the level of the adjoining area 202.

The field profile and surface is then prepared 204 as required by the site engineer. For example, the field is crowned, as in typical American football or leveled as in a typical soccer field. The preparation includes any needed water pitch and drainage such as perimeter drain collection areas, underground collection containers or straight percolation into the ground. The site engineers typically design the field profile and surface for rain water management.

Once the field profile has been achieved, the area is compacted 206. The compacting 206 produces a firm, smooth area.

Next, a material is laid on the prepared earth 208 and secured to the ground with spikes 209. Typically, this material is either a pervious or non-pervious geo textile and is determined based on the installation site soils, environmental characteristics and methodology of storm water management.

Next, the interlocked panels 10 of the present invention are installed. This installation includes joining the interlocking interlocked panels 10 of the present invention 210 and optionally inserting gap spacers 211 creating a predetermined gap width between the interlocked panels 10 to allow for the proper expansion and contraction that is typical with the selected polymers. Note, other methods of creating such a gap are known as described previously. If a tapered edge is required, the joining of the interlocking panels 10 includes joining of tapered edge interlocked panels 10 along the outermost edge, thereby creating a slight ramp up to the interlocked panels 10. Other interlocked panels 10 with various edge configurations are anticipated as well.

Note that the interlocked panels 10 allow water to pass either through drainage holes 184 (see FIGS. 20 and 21) or through the gaps between the interlocked panels 10. Water beneath the interlocked panels 10 is permitted to move laterally (approximately horizontally) beneath the interlocked panels 10 through the wire chases 50 in the bottom ribs of the interlocked panels 10.

The outside perimeter interlocked panels 10 are optionally screwed together 212 using fasteners such as self-tapping screws. The fasteners are left slightly loose to allow for expansion.

Next, if spikes 40 (see FIGS. 2 and 3) are needed, the spikes 40 are driven/installed 214 through the existing screw holes 18 along the outside perimeter of the interlocked panels 10. It is recommend, but not required, to install a spike 40 every 3 to 4 interlocked panel 10. When used, the spikes reduce movement of the interlocked panels 10 within the confines of the interlocked panel system and prevent expansion of the overall size during heating/cooling.

Next, the spacers are removed 216.

Next, a sheet of synthetic turf is now rolled out 218 on to the interlocked panels 10. There are many types of turf such as polypropylene, poly ethylene, nylon or combinations thereof. The synthetic turf typically includes a backing system. Some backing systems have anti slip backing while others do not. If multiple sheets of synthetic turf are needed, the sheets of synthetic turf are seamed together 220 using existing methods such as sewing, hook and loop connections, hot melt glue, tape and seam cloth, and chemical glues.

Once the sheet(s) of synthetic turf have been rolled out 218 and seamed together 220, the edges of the sheet(s) of synthetic turf are disposed 222. If desired, the edges of the sheet (s) of synthetic turf are left as a loose lay installation. Alternately, the edges of the sheet(s) of synthetic turf are buried the ground around the perimeter of the field, typically buried in around 6 inches of ground (e.g., soil, pebbles, etc.)

If needed, the sheet(s) of synthetic turf are affixed to the interlocked panels 10. The preferred method of affixing is to wait 224 for the sheet(s) of synthetic turf to acclimate to the weather (typically 24 hours but any amount of time is anticipated including one second), then stretching 226 the synthetic turf to make it flat then securing 228 the synthetic turf to the interlocked panels 10 along the perimeter. It is preferred to install staples though the synthetic turf and into the interlocked panels 10, preferably with a pneumatic stapler or other staple device. It is preferred to staple at intervals of every several inches around the perimeter working from one side of the field to the other while pulling the synthetic turf tight as progress is made.

If needed, after the synthetic turf is installed, the field is in-filled 230 to create ballast in the synthetic turf. Accepted methods of infilling include sand, rubber infill, rubber coated sand or combinations. Other infill products are anticipated in the present invention.

Figure 24:
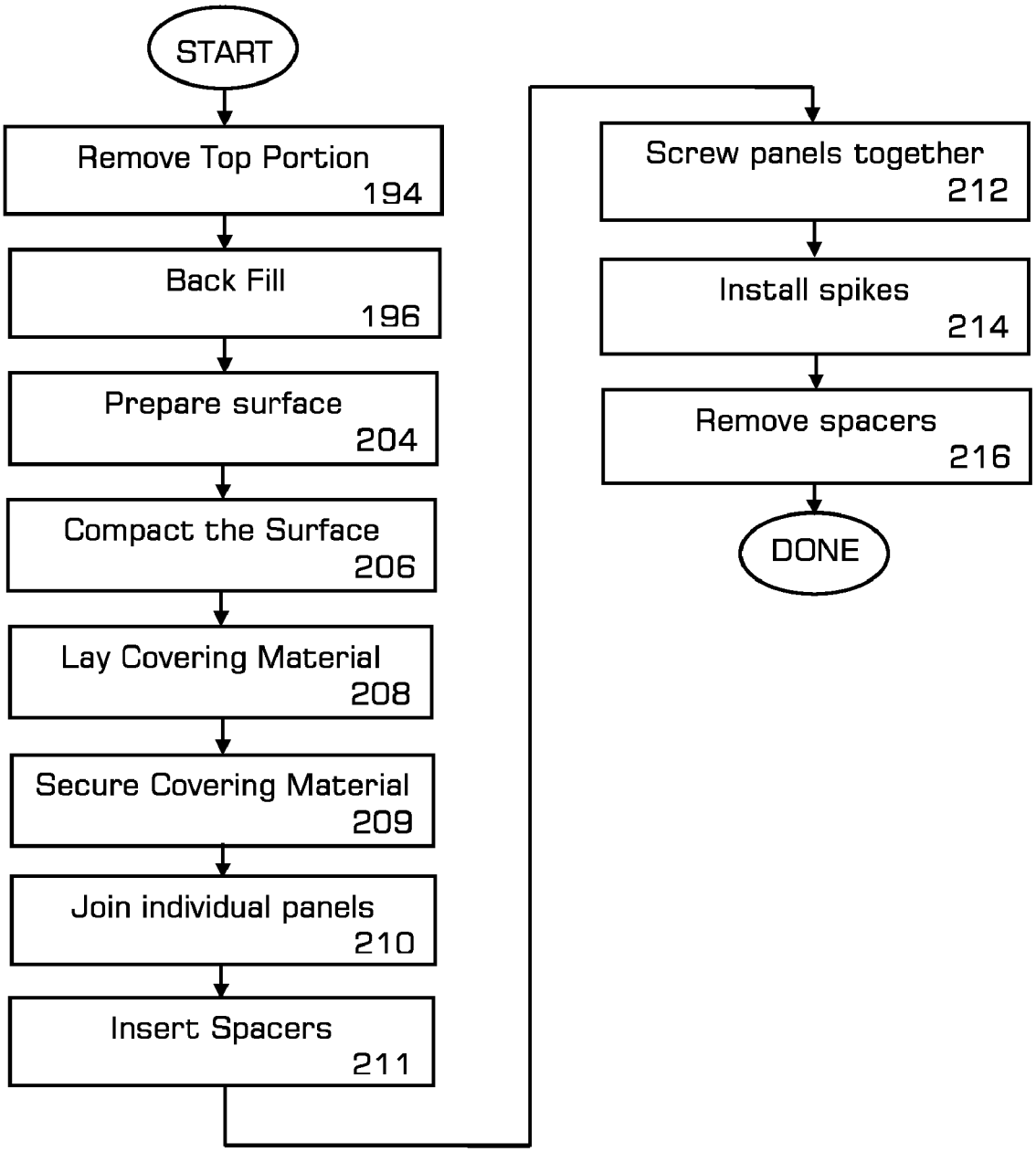
FIG. 24 is a third flow chart of a method of installing the surface of the present invention.

Referring to FIG. 24, a third flow chart of a method of installing the surface of the present invention is described. In installations of athletic courts, often the top layer of the interlocking panels 10 is the final surface. The interlocked panels 10 are the finished surface (unless the client chooses to cover the court with, for example, a synthetic grass suitable for tennis or lawn bowling). In some embodiments, storm water management techniques are not needed since proper water drainage is often provided by the slope and pitch of the sub grade.

The first step is to remove a percentage of the existing surface 194. Next, a more suitable material is back-filled 196 to create firmness when compacted and improved drainage. Typical field installations require between 6 inches and 18 inches of earth removal depending on drainage and frost heave. The depth of excavation required is decided by the installer and the soil engineers.

The field profile and surface is then prepared 204 as required by the site engineer. For example, the field is crowned, as in typical American football or leveled as in a typical soccer field. The preparation includes any needed water pitch and drainage such as perimeter drain collection areas, underground collection containers or straight percolation into the ground. The site engineers typically design the field profile and surface for rain water management.

Once the field profile has been achieved, the area is compacted 206. The compacting 206 produces a firm, smooth area.

Next, a material is laid on the prepared earth 208 and secured to the ground with spikes 209. Typically, this material is either a pervious or non-pervious geo textile and is determined based on the installation site soils, environmental characteristics and methodology of storm water management.

Next, the interlocked panels 10 of the present invention are installed. This installation includes joining 210 the interlocking interlocked panels 10 of the present invention, optionally inserting 211 gap spacers (or spacing with a tool) having a predetermined gap width between the interlocked panels 10 to allow for the proper expansion and contraction that is typical with the selected polymers. If a tapered edge is required, the joining of the interlocking panels 10 includes joining of tapered edge interlocked panels 10 along the outermost edge, thereby creating a slight ramp up to the interlocked panels 10. Other interlocked panels 10 with various edge configurations are anticipated as well.

Note that the interlocked panels 10 allow water to pass either through drainage holes or through the gaps between the interlocked panels 10. Water beneath the interlocked panels 10 is permitted to move laterally (approximately horizontally) beneath the interlocked panels 10 through the wire chases 50 in the bottom ribs of the interlocked panels 10.

The outside perimeter interlocked panels 10 are optionally screwed together using fasteners such as self-tapping screws 212. The fasteners are left slightly loose to allow for expansion.

Next, if spikes 40 (see FIGS. 2 and 3) are needed, the spikes 40 (e.g., stainless steel spikes) are driven/installed 214 through the existing screw holes 18 along the outside perimeter of the interlocked panels 10. It is recommend, but not required, to install a spike 40 every 3 to 4 interlocked panel 10. When used, the spikes 40 reduce movement of the interlocked panels 10 within the confines of the interlocked panel system and prevent expansion of the overall size during heating/cooling.

Finally, if inserted, the spacers are removed 216.

Figure 25:
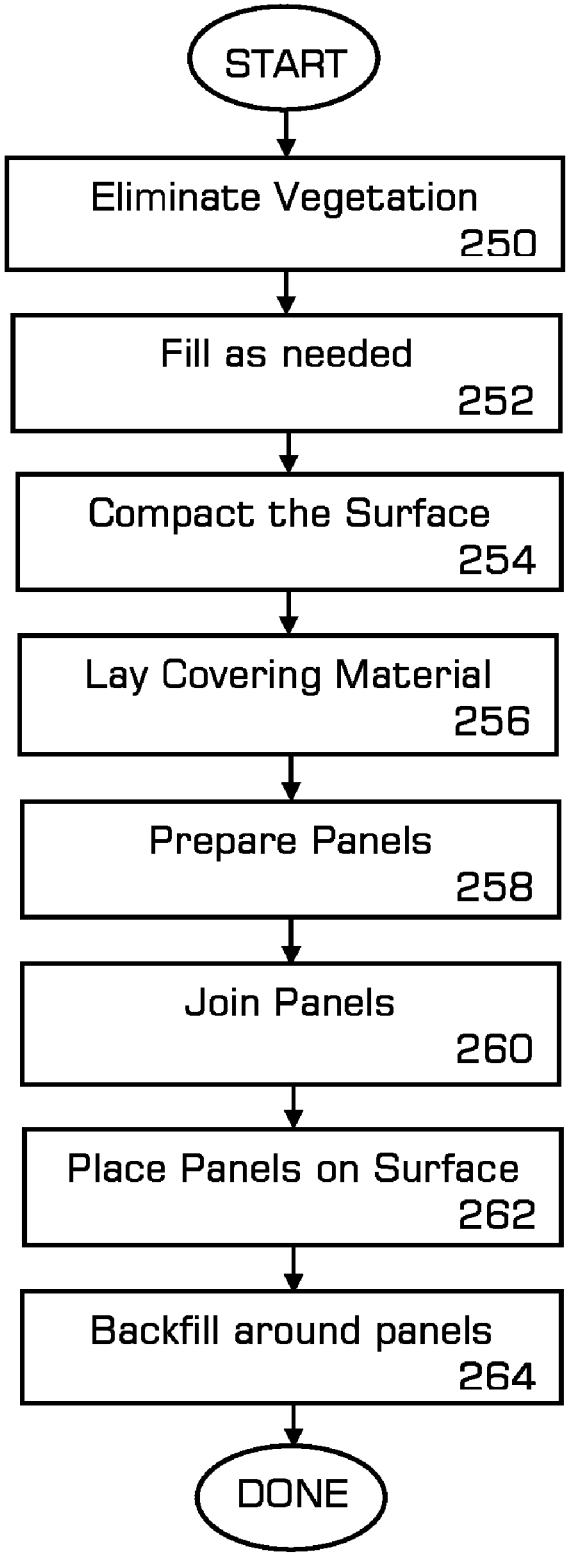
FIG. 25 is a fourth flow chart of a method of installing the surface of the present invention.

Referring to FIG. 25, a fourth flow chart of a method of installing the surface of the present invention for walkways and patios is described. Walkway and patio, residential and commercial installations start with eliminating vegetation 250 either using a vegetation killer or mowing to the earth level. It is preferred to avoid breaking the surface.

Next, fill material such as decomposed granite or limestone road screening material is added 252 to fill any low areas.

Next, the entire area is compacted 254, creating a firm smooth area. The area need not be level or flat but it is preferred that the area be smooth so the interlocked panels 10 rest evenly on the sub base.

Next, the area is covered 256 with a material to reduce weeds and create additional stability for the interlocked panels 10.

Next, the interlocked panels 10 are prepared 258, if needed, by cutting them to shape (e.g., to create custom designs or use the transition edges to create a ramp down to the existing grade) and the interlocking panels 10 are joined 260 and placed on the surface 262. If desired or needed, the interlocking panels 10 are held together with fasteners as previously described and, if desired, spikes 40 are installed to hold the interlocking panels 10 in place.

If desired, backfill 264 around the interlocking panels 10 up to the top of the panels to create the illusion the entire structure is built in to the ground.

The above description has described specific structural details in applying the invention. However, it will be within one having skill in the art to make modifications without departing from the spirit and scope of the underlying inventive concept of this interlock panel. The invention is not limited to the structure described and includes such modifications as are substantially equivalent to the elements of the interlock panels with or without a surface covering.

Figure 26:
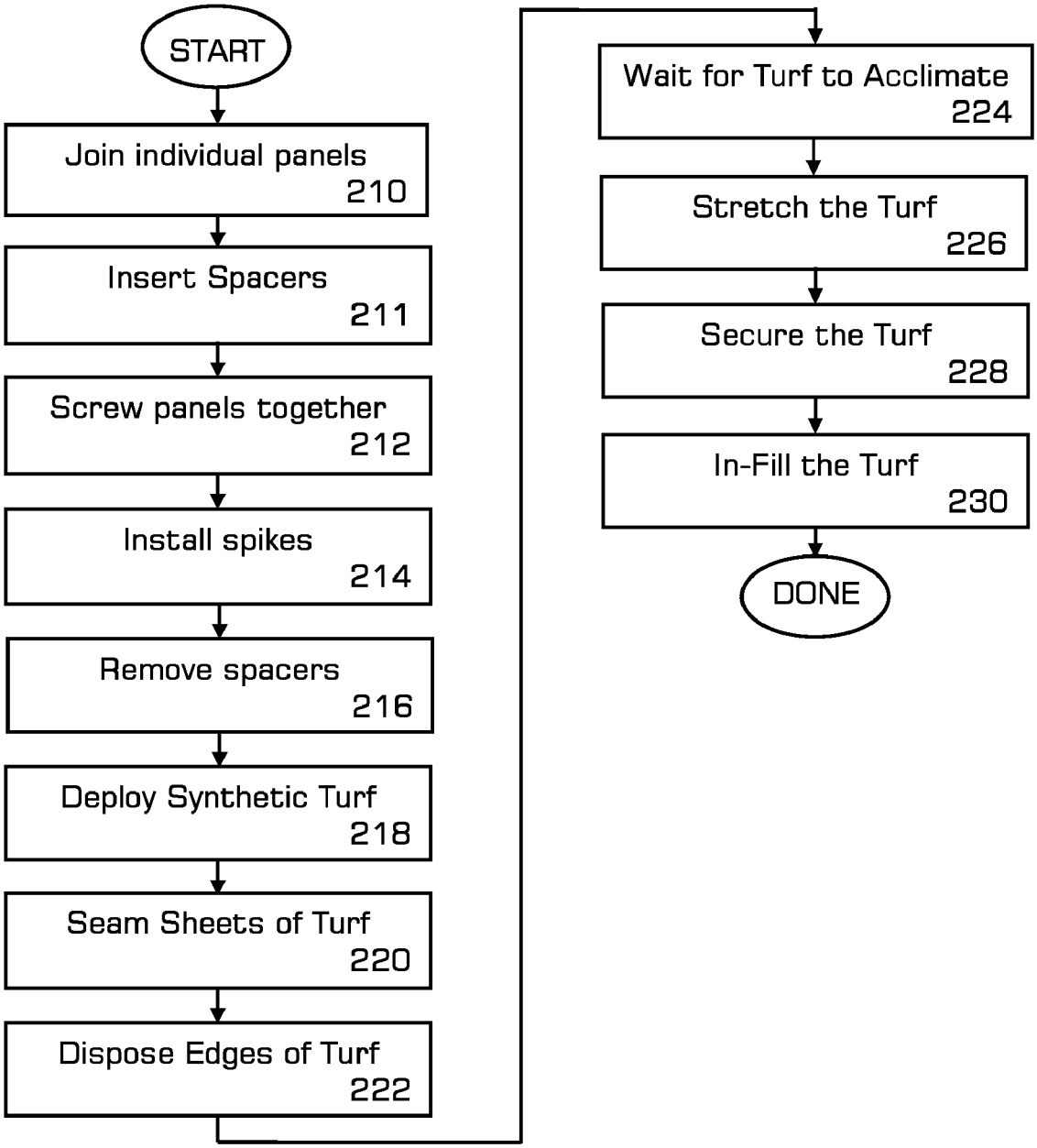
FIG. 26 is a fifth flow chart of a method of installing the surface of the present invention.

Referring to FIG. 26, a fifth flow chart of a method of installing the surface of the present invention is described. This method is useful for installing over existing hard surfaces such as concrete, asphalt and wood such as an existing tennis court or a roof.

The interlocked panels 10 of the present invention are installed over the existing surface. This installation includes joining the interlocking interlocked panels 10 of the present invention 210, optionally inserting gap spacers 211 creating a predetermined gap width between the interlocked panels 10 to allow for the proper expansion and contraction that is typical with the selected polymers. Other methods of creating a predetermined gap width between the interlock panels 10 are anticipated including using any object of suitable size to urge the interlock panels 10 apart, for example, a screw driver, etc. If a tapered edge is required, the joining of the interlocking panels 10 includes joining of tapered edge interlocked panels 10 along the outermost edge, thereby creating a slight ramp up to the interlocked panels 10. Other interlocked panels 10 with various edge configurations are anticipated as well.

Note that the interlocked panels 10 allow water to pass either through drainage holes 184 (see FIGS. 20 and 20) or through the gaps between the interlocked panels 10. Water beneath the interlocked panels 10 is permitted to move laterally (approximately horizontally) beneath the interlocked panels 10 through the wire chases 50 in the bottom ribs of the interlocked panels 10.

The outside perimeter interlocked panels 10 are optionally screwed together using fasteners such as self-tapping screws 212. The fasteners are left slightly loose to allow for expansion.

Next, if spikes are needed, the spikes 40 (see FIGS. 2 and 3) are driven (installed) 214 through the existing screw holes 18 along the outside perimeter of the interlocked panels 10. The spikes, for example, are made from stainless steel, plastic or other suitable material. It is recommend, but not required, to install a spike every 3 to 4 interlocked panel 10. When used, the spikes 40 reduce movement of the interlocked panels 10 within the confines of the interlocked panel system and prevent expansion of the overall size during heating/cooling.

Next, the spacers are removed 216.

Next, if desired, a sheet of synthetic turf is now rolled out 218 on to the interlocked panels 10. There are many types of turf such as polypropylene, polyethylene, nylon or combinations thereof. The synthetic turf typically includes a backing system, but this is not required. Some backing systems have anti slip backing while others do not. If multiple sheets of synthetic turf are needed, the sheets of synthetic turf are seamed together 220 using existing methods such as sewing, hook and loop connections, hot melt glue, tape and seam cloth, and chemical glues.

Once the sheet(s) of synthetic turf have been rolled out and seamed together, the edges of the sheet(s) of synthetic turf are disposed 222. If desired, the edges of the sheet(s) of synthetic turf are left as a loose lay installation. Alternately, the edges of the sheet(s) of synthetic turf are buried the ground around the perimeter of the field, typically buried in around 6 inches of ground (e.g., soil, pebbles, etc.)

If needed, the sheet(s) of synthetic turf are affixed 224 to the interlocked panels 10. The preferred method of affixing is to wait for the sheet(s) of synthetic turf to acclimate 224 to the weather (typically 24 hours but any amount of time is anticipated, including one second), then stretching 226 the synthetic turf to make it flat then securing 228 the synthetic turf to the interlocked panels 10 along the perimeter. It is preferred to install staples though the synthetic turf and into the interlocked panels 10, preferably with a pneumatic stapler or other staple device. It is preferred to staple at intervals of every several inches around the perimeter working from one side of the field to the other while pulling the synthetic turf tight as progress is made.

If needed, after the synthetic turf is installed, the field is in-filled 230 to create ballast in the synthetic turf. Accepted methods of infilling include sand, rubber infill, rubber coated sand or combinations. Other infill products are anticipated in the present invention.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes. For example, throughout the description, the convex projection is located on the bottom of the downward facing step and the concave dimple is located on the top of the upward facing step, but the present invention works equally as well with the convex projection located on the top of the upward facing step and the concave dimple on the bottom of the downward facing step.

What is claimed is:

1. A method of installing an interlocked floor system, the method comprising:

providing multiple polymeric panels molded as an integral body having a planar top surface and a grid structure supporting the top surface and multiple interlocking side surfaces; each interlocking side surface having upwardly and downwardly facing steps, at least one of the downwardly facing steps have a convex projection on a bottom surface, at least one of the upwardly facing steps have a concave mating dimple on an upper surface; an over hang ledge formed as an extension of the planar top surface, thereby forming a cavity between the over hang ledge and the upper surface of the upwardly facing step; an under hang ledge formed in a top surface of the downwardly facing step allowing the downward facing step of a first panel to fit within the cavity of a second panel; and whereas the steps of the side surfaces of the first panel interlock to complementary steps of the second panel, held in place by the convex projections and the mating concave dimples;

removing a top portion of soil;

backfilling with a backfill material to replace the top portion of soil;

preparing a surface over the backfill material;

compacting the surface;

installing a cover material over the surface;

joining the multiple polymeric panels and installing the multiple polymeric panels over the cover material;

installing spikes through holes in a subset of the multiple polymeric panels; and deploying a synthetic turf over the multiple polymeric panels.

2. The method according to claim 1, further comprising a step of inserting spacers between the multiple polymeric panels after the step of joining the multiple polymeric panels; and further comprising the step of removing the spacers after the step of installing the spikes.

3. The method according to claim 1, further comprising a step of securing the cover material to the surface after the step of installing the cover material over the surface.

4. The method according to claim 1, further comprising a step of fastening the multiple polymeric panels together using a fastener after the step of joining the multiple polymeric panels.

5. The method according to claim 1, wherein the synthetic turf comprises a plurality of synthetic turf sheets and the method further comprising a step of seaming the multiple synthetic turf sheets together after the of step deploying the synthetic turf.

6. The method according to claim 1, further comprising, after the step of deploying the synthetic turf, steps of:

stretching the synthetic turf; and securing the synthetic turf to the multiple polymeric panels.

7. The method according to claim 1, further comprising, after the step of deploying the synthetic turf, steps of:

waiting for the synthetic turf to acclimate;

stretching the synthetic turf; and securing the synthetic turf to the multiple polymeric panels.

8. The method, according to claim 1, further comprising a step of in-filling the synthetic turf after the step of deploying the synthetic turf.

9. A method of installing an interlocked floor system, the method comprising:

providing multiple polymeric panels molded as an integral body having a planar top surface and a grid structure supporting the top surface and multiple interlocking side surfaces; each interlocking side surface having upwardly and downwardly facing steps, at least one of the downwardly facing steps have a convex projection on a bottom surface, at least one of the upwardly facing steps have a concave mating dimple on an upper surface; an over hang ledge formed as an extension of the planar top surface, thereby forming a cavity between the over hang ledge and the upper surface of the upwardly facing step; an under hang ledge formed in a top surface of the downwardly facing step allowing the downward facing step of a first panel to fit within the cavity of a second panel; and whereas the steps of the side surfaces of the first panel interlock to complementary steps of the second panel, held in place by the convex projections and the mating concave dimples;

eliminating vegetation from a field area;

filling low areas and reducing high areas of the field area;

preparing a surface of the field area;

compacting the surface of the field area;

installing a cover material over the surface of the field area;

joining the multiple polymeric panels;

installing spikes through holes in a subset of the multiple polymeric panels; and deploying a synthetic turf over the multiple polymeric panels.

10. The method, according to claim 9, further comprising a step of inserting spacers between the multiple polymeric panels after the step of joining the multiple polymeric panels; and further comprising the step of removing the spacers after the step of installing the spikes.

11. The method, according to claim 9, further comprising a step of securing the cover material to the surface after the step of installing the cover material over the surface.

12. The method according to claim 9, further comprising a step of fastening the multiple polymeric panels together using a fastener after the step of joining the multiple polymeric panels.

13. The method according to claim 9, wherein the synthetic turf comprises a plurality of synthetic turf sheets and the method further comprising a step of seaming the multiple synthetic turf sheets together after the step deploying the synthetic turf.

14. The method according to claim 9, further comprising, after the step of deploying the synthetic turf, steps of:

stretching the synthetic turf; and securing the synthetic turf to the multiple polymeric panels.

15. The method according to claim 9, further comprising a step of in-filling the synthetic turf after the step of deploying the synthetic turf.

16. The method, according to claim 9, wherein the subset of the multiple polymeric panels are the polymeric panels around the peripheral of the field.

17. A method of installing an interlocked floor system, the method comprising:

providing multiple polymeric panels molded as an integral body having a planar top surface and a grid structure supporting the top surface and multiple interlocking side surfaces; each interlocking side surface having upwardly and downwardly facing steps, at least one of the downwardly facing steps have a convex projection on a bottom surface, at least one of the upwardly facing steps have a concave mating dimple on an upper surface; an over hang ledge formed as an extension of the planar top surface, thereby forming a cavity between the over hang ledge and the upper surface of the upwardly facing step; an under hang ledge formed in a top surface of the downwardly facing step allowing the downward facing step of a first panel to fit within the cavity of a second panel; and whereas the steps of the side surfaces of the first panel interlock to complementary steps of the second panel, held in place by the convex projections and the mating concave dimples;

eliminating vegetation from an area;

filling low areas and reducing high areas of the area;

compacting the surface of the area;

installing a cover material over the surface of the area;

joining the multiple polymeric panels; and placing the multiple polymeric panels over the cover material.

18. The method according to claim 17, further comprising a step of securing the cover material to the surface after the step of installing the cover material over the surface.

19. The method according to claim 17, further comprising a step of fastening the multiple polymeric panels together using a fastener after the step of joining the multiple polymeric panels.

20. The method according to claim 17, further comprising a step of preparing the multiple polymeric panels after the step installing the cover material.

21. The method according to claim 17, further comprising a step of backfilling around the multiple polymeric panels after the step of placing multiple polymeric panels.

22. A method of installing an interlocked floor system, the method comprising:

providing multiple polymeric panels molded as an integral body having a planar top surface and a grid structure supporting the top surface and multiple interlocking side surfaces; each interlocking side surface having upwardly and downwardly facing steps, at least one of the downwardly facing steps have a convex projection on a bottom surface, at least one of the upwardly facing steps have a concave mating dimple on an upper surface; an over hang ledge formed as an extension of the planar top surface, thereby forming a cavity between the over hang ledge and the upper surface of the upwardly facing step; an under hang ledge formed in a top surface of the downwardly facing step allowing the downward facing step of a first panel to fit within the cavity of a second panel; and whereas the steps of the side surfaces of the first panel interlock to complementary steps of the second panel, held in place by the convex projections and the mating concave dimples;

joining the multiple polymeric panels;

placing the multiple polymeric panels over a cover material; and deploying a synthetic turf over the multiple polymeric panels.

23. The method according to claim 22, further comprising a step of fastening the multiple polymeric panels together using a fastener after the step of joining the multiple polymeric panels.

* * * * *

Disclaimer 7,930,865—David R. Barlow, Seminole, FA. METHOD OF INSTALLING AN INTERLOCKING FLOOR SYSTEM. Patent dated April 26, 2011. Disclaimer filed Feb. 10, 2011, by the inventor, David R. Barlow.

The term of this patent shall not extend beyond the expiration date of Pat. No. 7516587.

(*Official Gazette* May 24, 2011)